US006286921B1

(12) United States Patent
Ochi et al.

(10) Patent No.: US 6,286,921 B1
(45) Date of Patent: Sep. 11, 2001

(54) INK CARTRIDGE OF AN INK JET PRINTER AND AN INK JET PRINTER INCLUDING AN INK CARTRIDGE

(75) Inventors: Norihiro Ochi, Yamatokoriyama; Kohji Tsurui, Sakurai; Kouichi Fukushima, Yamatokoriyama; Kazuya Koyama, Ikoma; Hisashi Yoshimura, Nara; Kouzou Yamaguchi; Shigenori Morimoto, both of Kashihara; Takayuki Higashio, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 08/222,913

(22) Filed: Apr. 5, 1994

(30) Foreign Application Priority Data

Apr. 6, 1993 (JP) ..... 5-079390
Apr. 30, 1993 (JP) ..... 5-104279

(51) Int. Cl.[7] ..... B41J 2/195
(52) U.S. Cl. ..... 347/7
(58) Field of Search ..... 347/7, 85, 86, 347/87, 100; 355/260

(56) References Cited

U.S. PATENT DOCUMENTS

| | | | | |
|---|---|---|---|---|
| 4,153,467 | * | 5/1979 | Yano et al. | 347/100 |
| 4,196,625 | * | 4/1980 | Kern | 347/7 |
| 4,202,267 | * | 5/1980 | Heinzl et al. | 347/7 |
| 4,243,700 | * | 1/1981 | Piazza | 427/195 |
| 4,380,772 | * | 4/1983 | Italiano | 347/85 |
| 4,626,874 | * | 12/1986 | Murai et al. | 347/7 |
| 4,719,475 | * | 1/1988 | Kiyohara et al. | 347/86 |
| 4,788,861 | * | 12/1988 | Lichti | 347/7 |
| 4,956,230 | * | 9/1990 | Edwards et al. | 428/341 |
| 4,977,413 | * | 12/1990 | Yamanaka et al. | 347/7 |
| 5,162,817 | * | 11/1992 | Tajika et al. | 347/86 |
| 5,563,644 | * | 10/1996 | Isganitis et al. | 347/100 |

FOREIGN PATENT DOCUMENTS

| | | | | |
|---|---|---|---|---|
| 2728283 | | 1/1979 | (DE) . | |
| 4012708 | | 10/1991 | (DE) . | |
| 0236937 | | 3/1987 | (EP) . | |
| 0381392 | | 8/1990 | (EP) . | |
| 0440110 | | 1/1991 | (EP) . | |
| 488829A2 | * | 6/1992 | (EP) | 347/87 |
| 493058 | * | 7/1992 | (EP) | 347/87 |
| 56-125339U | | 9/1981 | (JP) . | |
| 59-214656 | * | 12/1984 | (JP) | B41J/3/04 |
| 24151 | * | 1/1990 | (JP) | 347/7 |
| 3275360A | | 6/1991 | (JP) . | |
| 197646 | * | 7/1992 | (JP) | 347/7 |
| 5105833A | | 4/1993 | (JP) . | |

OTHER PUBLICATIONS

Handbook of Chemistry and Physics, Thirtieth Edition, Charles D. Hodgman, 1948.*
Fluid Mechanics, Second Edition, Frank M. White, 1986.*

* cited by examiner

*Primary Examiner*—Judy Nguyen
*Assistant Examiner*—Kevin Saunders

(57) ABSTRACT

In a container, an ink exhausting detecting liquid permeable sponge and an ink permeable sponge are disposed with an isolation film therebetween. The ink exhaustion detecting liquid is oil based, and has a resistance value higher than that of ink, and a specific gravity smaller than that of ink. In usage, the isolation film is drawn out of the container, whereby the ink exhaustion detecting liquid permeable sponge is brought into contact with the ink permeable sponge.

4 Claims, 33 Drawing Sheets

FIG. 32(a)
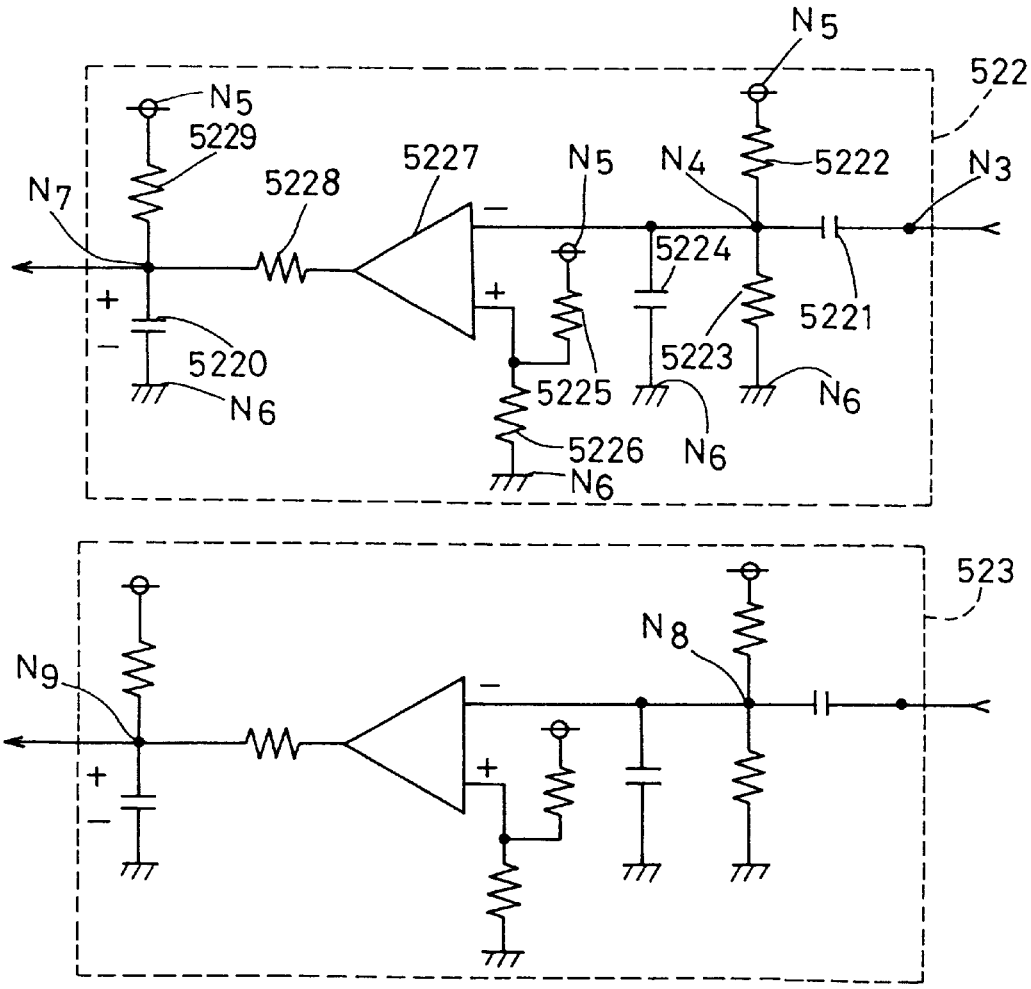
FIG. 32(b)
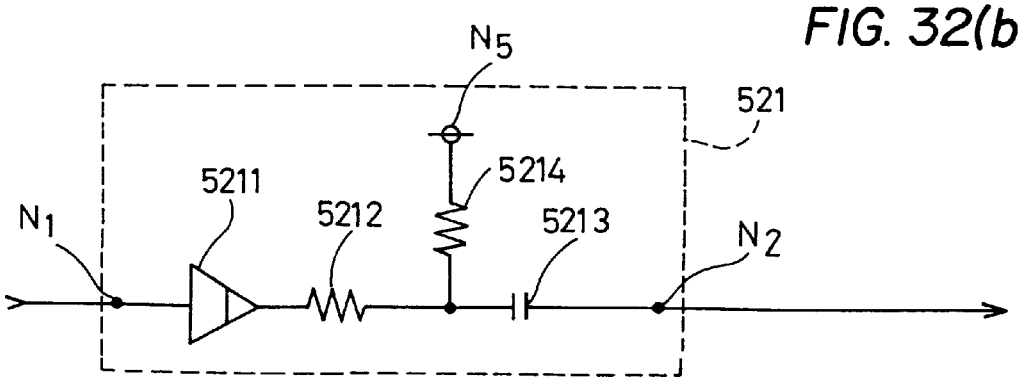
FIG. 32(c)

INK CARTRIDGE OF AN INK JET PRINTER AND AN INK JET PRINTER INCLUDING AN INK CARTRIDGE

BACKGROUND OF THE INVENTION

1. Field of the Invention

The present invention relates to an ink cartridge used in an ink jet printer, and an ink jet printer including an ink cartridge. Particularly, it relates to improvement of an ink cartridge and an ink jet printer that allows detection of the remaining amount of ink in the cartridge.

2. Description of the Background Art

An ink jet printer sprays out ink from a nozzle of a print head that moves parallel to an object to be printed to print out characters and images. A detachable ink cartridge as well as a nozzle are attached to the print head. The ink in the ink cartridge is sprayed out by pressurization means or electrostatic means.

When the amount of ink inside an ink cartridge is low, it is necessary to sense the low supply and identify the time to exchange the ink cartridge or to interrupt a printing process. A conventional ink jet printer and ink cartridge is provided with means to detect the amount of ink in the ink cartridge.

Means for detecting the remaining amount of ink includes a type that detects the amount of ink mechanically and electrically.

An ink jet printer will be described hereinafter including detecting means for mechanically detecting the remaining amount of ink. FIG. 36 is a perspective view of a structure of an ink cartridge of a first conventional ink jet printer. Ink is stored in an accommodating bag 101. Accommodating bag 101 is formed to contract in one direction according to decrease of the remaining amount of ink, and has a supply tube 102 for the outflow of ink. Accommodating bag 101 is placed in a box type cartridge case 103 with supply tube 102 projecting outwards. A plate 104 for detecting the remaining amount of ink is attached to the contraction region of accommodating bag 101 in cartridge case 103. A portion of plate 104 protrudes outward from a rectangular opening 105 formed in a longitudinal direction which is identical to the contraction direction of accommodating bag 101.

According to an ink cartridge of the above-described structure, plate 104 travels within rectangular opening 105 in response to the contraction of accommodating bag 101 as the remaining amount of ink becomes lower. A switch for detecting whether there is ink or not is provided in the main body of the ink jet printer to which this ink accommodating unit is loaded. When plate 104 travels a predetermined amount according to decrease of the remaining amount of ink, this switch is turned on to inform that the ink is exhausted.

A conventional ink jet printer having means for electrically detecting the remaining amount of ink will be described hereinafter. A conventional ink jet printer had electrodes provided in the proximity of an ink supply hole at the lower portion of an ink cartridge. A method is employed for detecting the remaining amount of ink by measuring the electrical resistance of the ink. According to this detection method, the electrical resistance between the electrodes increases when there is no ink around the electrodes. A low supply of ink can be identified according to the measured value of electrical resistance between the electrodes. Two types of ink jet printers detecting decrease in the amount of ink in an ink cartridge using such a detection method will be described hereinafter.

A second conventional ink jet printer including detection means for detecting electrically the remaining amount of ink will be described with reference to FIG. 37 showing a sectional view of an ink cartridge.

Referring to FIG. 37, an ink permeable sponge 4004 having a porous member impregnated with ink is installed in a container 4001. A pair of electrodes 4006 are provided at the lower portion of container 4001 as an out-of-ink sensor. An ink supply hole 4010 is provided at the lower portion of container 4001 communicating with a nozzle of a print head not shown. A pore is provided at the upper portion of container 4001. This pore 4011 supplies air into the ink cartridge to assist ink flow during the usage of the ink cartridge.

A third conventional ink jet printer having detection means for electrically detecting the remaining amount of ink is disclosed in Japanese Patent Laying-Open No. 3-277558. According to this ink jet printer, an ink accommodating unit includes an ink reservoir having a porous material for impregnating ink and an ink fountain communicating with the ink reservoir. Ink is supplied to a print head from the ink fountain.

Electrodes are provided in a portion of the porous material in the ink reservoir and in a portion of the ink fountain. A remaining amount detection unit is provided for detecting the remaining amount of ink according to the change in resistance between the electrodes.

When ink in the ink accommodating unit becomes nearly exhausted in the ink jet printer of the above-described structure, air will be introduced into the joint portion between the ink reservoir and the ink fountain to reduce the area of the joining portion, whereby resistance between the electrodes suddenly increases.

In this ink jet printer, the characteristics of the relationship between the remaining amount of ink and the resistance between the electrodes is obtained previously, and the value of the change in resistance when the ink is near exhaustion is previously set in the remaining amount detection unit. In the remaining amount detection unit, the change in the resistance between the electrodes is detected, whereby that change and a preset value of change are compared. Determination is made that the ink is near exhaustion when the values match.

The above-described conventional ink jet printers have problems as set forth in the following regarding detection of the remaining amount of ink. The above-described first conventional ink jet printer detecting mechanically the remaining amount of ink had a problem that the detection precision is low since the deformation characteristics of accommodating bag 101 differs from bag to bag.

In the ink cartridge of the above-described second conventional ink jet printer, sufficient spacing between electrodes 4006 is necessary in order to detect reduction of the amount of ink on the basis of increase in electrical resistance between electrodes 4006. If the spacing between electrodes 4006 is not sufficient, ink will remain between the electrodes, leading to a problem that decrease in ink could not be detected. Also, there is a problem that the size of the ink cartridge could not be reduced. Furthermore, when ink is permeated into a sponge or the like, there was a possibility of decrease in the amount of ink not being able to be detected due to residue ink in the sponge.

In the third conventional ink jet printer detecting electrically the remaining amount of ink, the characteristics of the relationship between the remaining amount of ink and the resistance is non-linear. Detection of the remaining amount of ink on the basis of comparison between a measured value and a set value of the change in resistance obtained by such characteristics was not reliable, leading to a problem of low detection accuracy. There was also a problem that the structure of the ink remaining amount detection system is complicated since the measured value and the set value regarding the change of resistance have to be continuously compared.

SUMMARY OF THE INVENTION

An object of the present invention is to obtain reliable detection of ink exhaustion in an ink cartridge of an ink jet printer.

Another object of the present invention is to improve detection precision of the remaining amount of ink without making complicated the structure associated with detection of the remaining amount of ink.

An ink cartridge of an ink jet printer according to the present invention includes a container for storing liquid. Ink and an ink exhaustion detecting liquid are stored in the container.

The ink exhaustion detecting liquid is accommodated within the container to detect ink exhaustion according to the ink exhaustion detecting liquid. Therefore, detection of exhaustion of ink in a cartridge can be reliably carried out.

An ink cartridge of an ink jet printer according to another aspect of the present invention includes a container for supplying ink outwards. The container includes ink, an ink exhaustion detecting liquid that is not miscible with ink and has a specific gravity lower than and electrical resistance greater than those of ink, and electrodes for detecting ink exhaustion according to the difference in electrical resistance of ink and ink exhaustion detecting liquid.

Because the ink exhaustion detecting liquid has a specific gravity lower than that of ink and is not soluble with ink, the liquid will be located above the ink within the ink cartridge. As the amount of ink decreases in the ink cartridge, the ink detecting liquid will come between the electrodes. The resistance value between the electrodes increases in comparison with the case where there is ink between the electrodes. Therefore, ink exhaustion can be reliably detected.

Even if a porous member is interposed between the electrodes and impregnated with ink, the ink permeating porous member is substituted with the ink exhaustion detecting liquid, so that decrease in the amount of ink can be reliably detected.

An ink jet printer according to a further aspect of the present invention includes an ink accommodating unit, an ink draw-out unit, a plurality of electrodes, and a remaining amount detection circuit.

The ink accommodating unit includes an ink permeable chamber for being permeated with ink, and an ink chamber for storing ink. Ink is supplied from the ink permeable chamber to the ink chamber. The ink draw-out unit has the ink accommodating unit attached in a detachable manner. Ink is drawn out from the ink chamber of the attached ink accommodating unit.

The plurality of electrodes are provided in the ink chamber of the ink accommodating unit with a predetermined distance therebetween when the ink accommodating unit is attached to the ink draw-out unit. The remaining amount detection circuit detects the remaining amount of ink in the ink accommodating unit according to state of conductance between the electrodes.

By attaching the ink accommodating portion to the ink draw-out portion, ink is drawn out from the ink chamber of the ink accommodating unit. When the amount of ink supplied from the ink permeable chamber to the ink chamber becomes low, the amount of ink in the ink chamber decreases.

When there is ink exceeding a predetermined amount in the ink chamber, the plurality of electrodes provided within the ink chamber will be located in the liquid of ink. The electrodes are surrounded by ink, and conduction is obtained between the electrodes via the ink. When the amount of ink in the ink chamber becomes low, the electrode located at the upper position in the ink chamber is exposed from the liquid of ink, whereby the electrodes no longer conduct.

It is possible to determine whether the remaining amount of ink in the ink accommodating unit is below a predetermined value or not according to conduction between the electrodes. The remaining amount detection circuit carries out detection of the remaining amount of ink in the ink accommodating unit according to conduction between the electrodes.

Because the remaining amount of ink can be detected according to the state of conduction between a plurality of electrodes provided in the ink chamber, the structure of the apparatus can be simplified. Because the conduction state across the electrodes take either a conductive state or a non-conductive state, detection of the remaining amount of ink according to the state of conduction between the electrodes can be carried out without vagueness. Thus, the detection precision of the remaining amount of ink can be improved without making complicated the structure of the apparatus.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 32(*a*)–32(*c*) are circuit diagrams showing a structure of a transmission circuit and a reception circuit of an ink remaining amount detection unit according to the tenth embodiment.

DESCRIPTION OF THE PREFERRED EMBODIMENTS

First Embodiment

Figure 1:
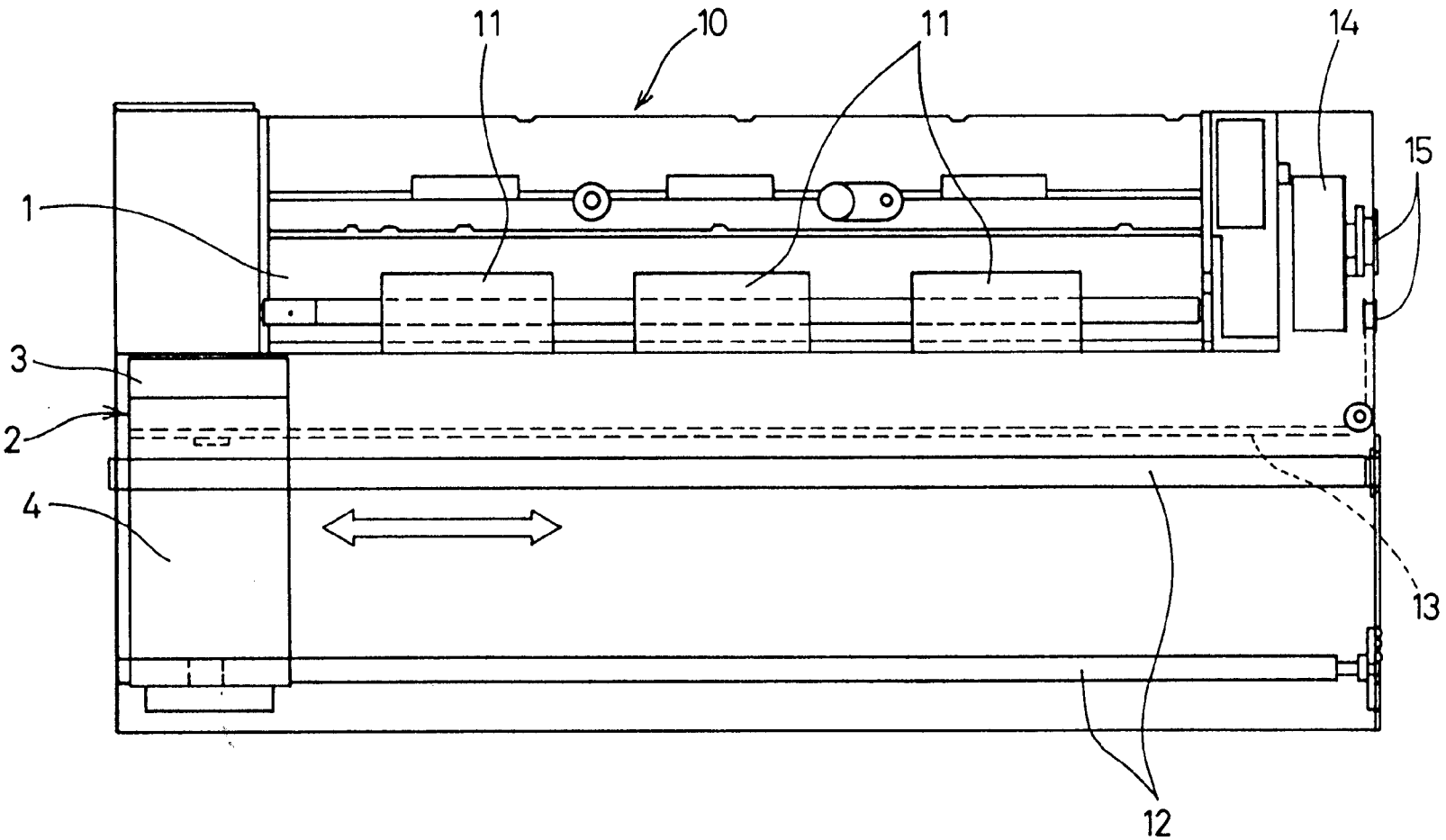
FIG. 1 is a plan view of a structure of an ink jet printer according to the present invention.

FIG. 1 is a plan view showing a structure of an ink jet printer according to the present invention. On a printer main body are provided in parallel a platen roller 1 on which a printing paper is wound, a feed roller 11 for conveying a printing paper, and a slide shaft 12 for moving a carriage 2 with a print head 3. Carriage 2 is provided on slide shaft 12 in a slidable manner in the longitudinal direction (open double ended arrow in the figure).

Print head 3 is provided in carriage 2 being opposed to platen roller 1. An ink cartridge 4 serving as ink accommodating means is load on carriage 2 in a detachable manner.

Carriage 2 is fixed to a portion of a timing belt 13 provided along slight shaft 12. Timing belt 13 is engaged to a pulley 15 rotated by a carriage travel motor 14. Timing belt 13 is driven according to the drive of carriage travel motor 14. Carriage 2 moves on slide shaft 12 according to the drive of timing belt 13.

Figure 2:
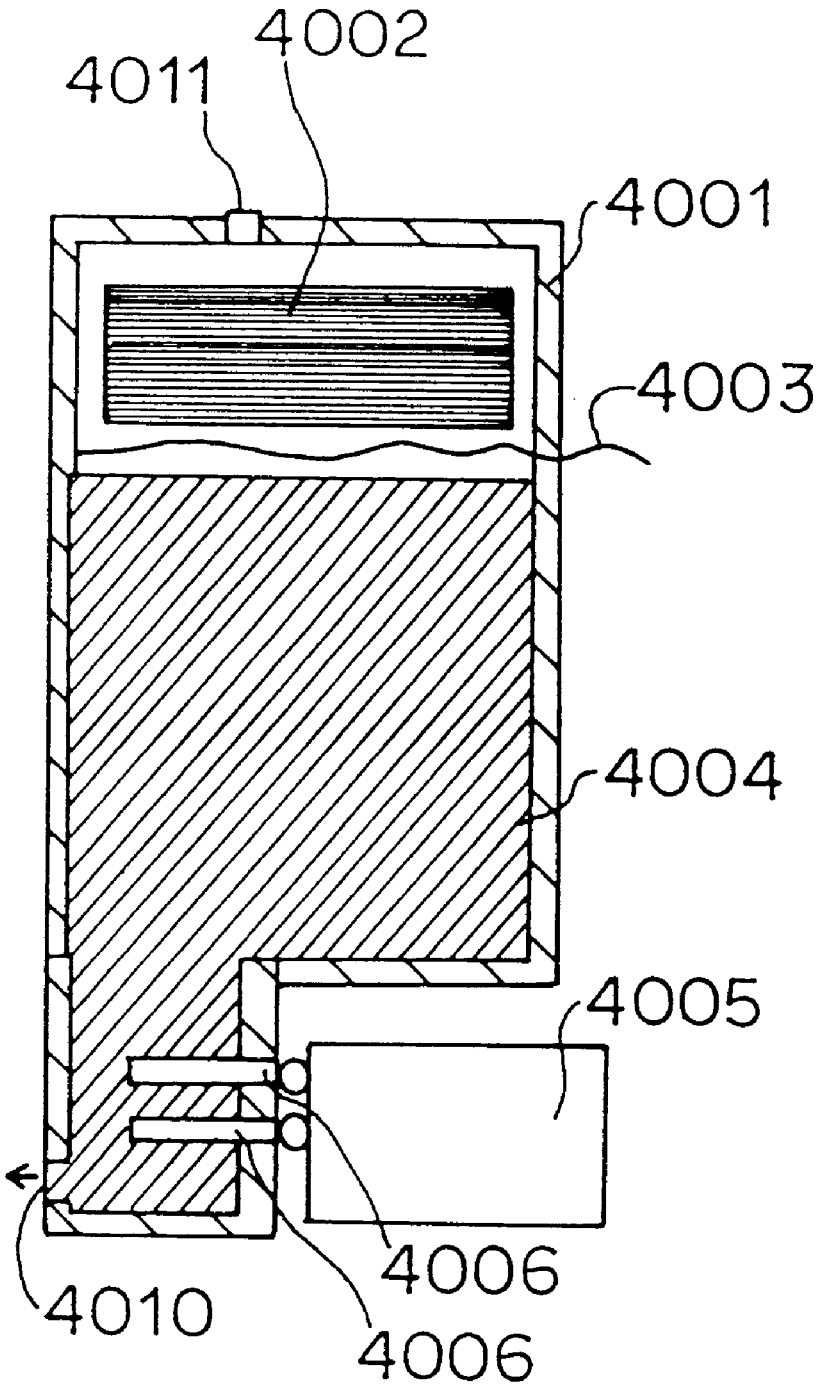
FIG. 2 is a sectional view of an ink cartridge according to a first embodiment of the present invention prior to usage.
Figure 37:
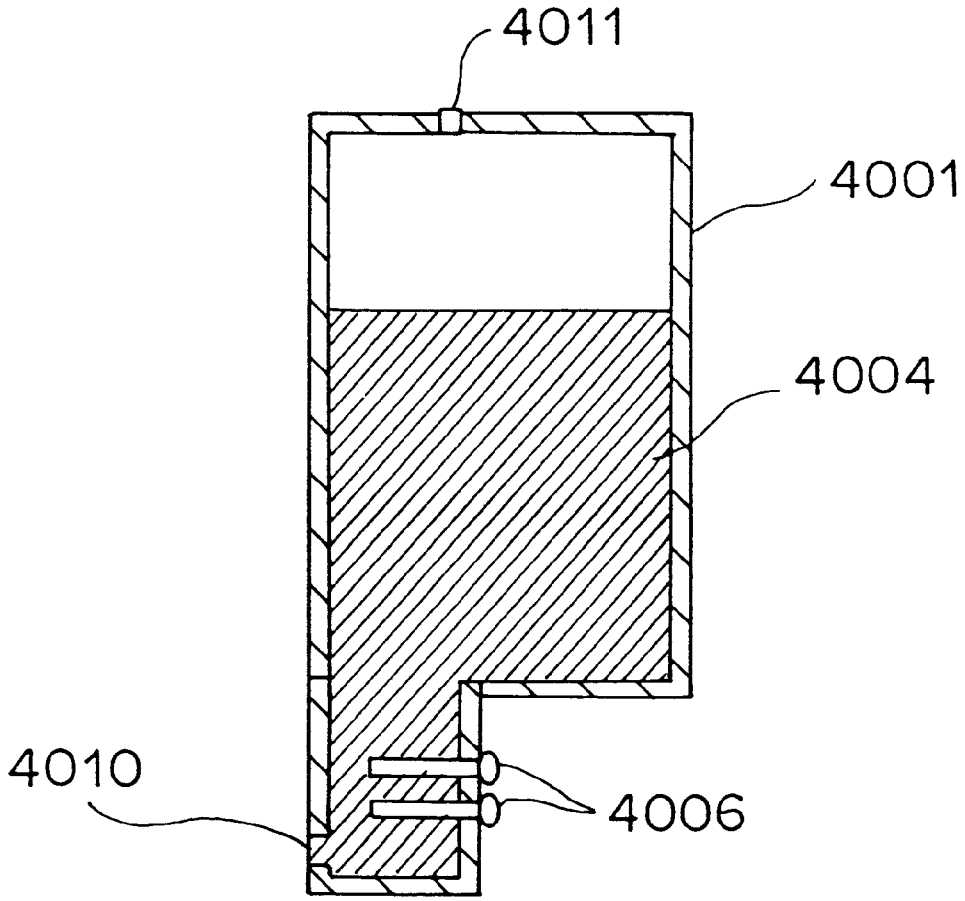
FIG.37 PRIOR ART
FIG. 37 is a sectional view of an ink cartridge according to a second conventional ink jet printer.

FIG. 2 is a sectional view of ink cartridge 4 of the first embodiment. In FIG. 2, components corresponding to those of FIG. 37 have the same reference characters denoted, and their description will not be repeated.

A sponge 4002 of a first porous member and impregnated with an ink exhaustion detecting liquid is accommodated at the upper portion of container 4001. In container 4001, a sponge 4004 of a second porous member and impregnated with ink is located below ink exhaustion detecting liquid permeable sponge 4002 with an isolation film 4003 therebetween. The relationship between the ink exhaustion detecting liquid in ink exhaustion detecting liquid permeable sponge 4002 and ink in ink permeable sponge 4004 will be described afterwards.

A circuit 4005 for detecting ink exhaustion is of a conventional type well known. Ink exhaustion detection circuit 4005 is connected to electrodes 4006 provided at the lower portion of container 1. Isolation film 4003 is provided so as to be pulled out from container 4001. By pulling out isolation film 4003 from container 4001, ink exhaustion detecting liquid permeable sponge 4002 is brought into contact with ink permeable sponge 4004.

Figure 3:
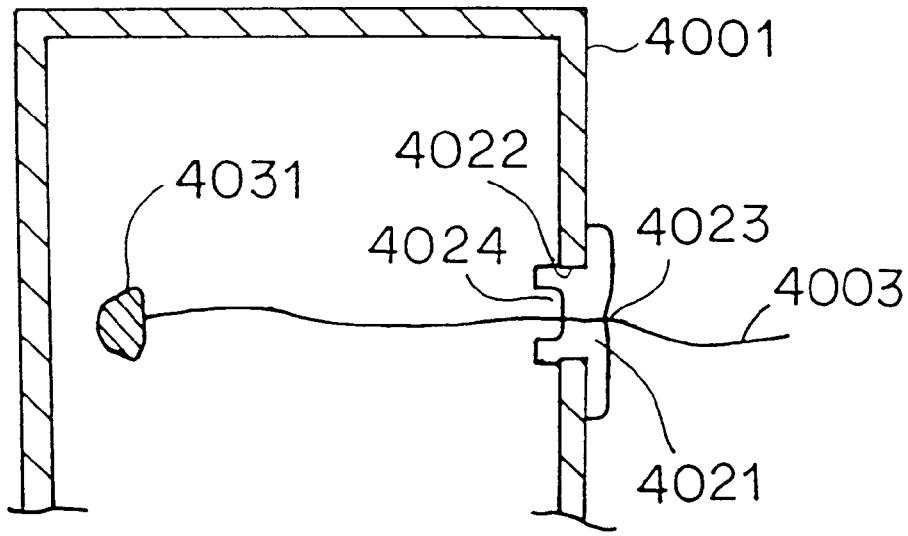
FIG. 3 is a partially enlarged sectional view of the ink cartridge of FIG. 2 when an isolation film is beginning to be pulled out from the container.
Figure 4:
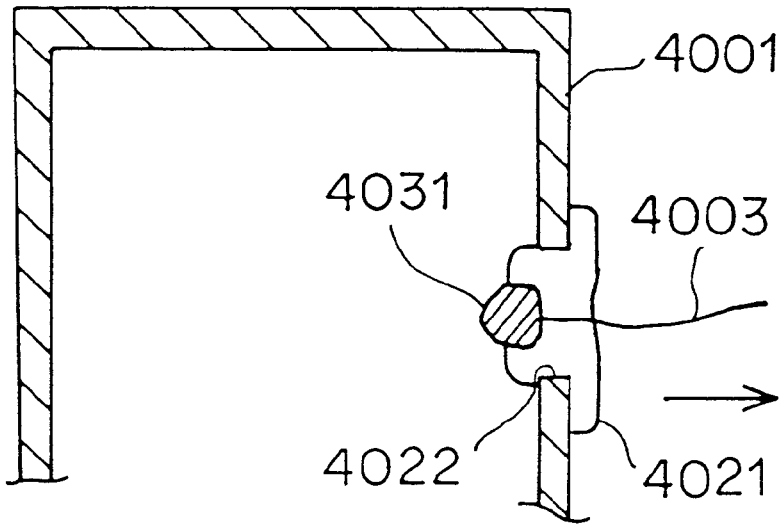
FIG. 4 is a partially enlarged sectional view of the ink cartridge of FIG. 2 when the isolation film is completely pulled out from the container.

Usage of isolation film 4003 in container 4001 will be described hereinafter. FIG. 3 is a sectional view of an ink cartridge showing the state where isolation film 4003 is being pulled out from container 4001. FIG. 4 is a sectional view of the ink cartridge showing the state where isolation film 4003 is completely pulled out from container 4001.

Isolation film 4003 is formed of a flexible film member. A plug member 4031 is attached to the edge of isolation film 4003. Plug member 4031 is formed of, for example, rubber. When the ink cartridge is not used, plug member 4031 adheres to the inner wall face of container 4001 to prevent the liquid of ink exhaustion detection liquid permeable sponge 4002 from flowing downwards.

A rubber member 4021 is attached to a hole 4022 provided at the wall face of container 4001. This rubber member 4021 prevents liquid from flowing out from container 4001. A draw out hole 4023 is provided in rubber member 4021. Isolation film 4003 and draw out hole 4023 are in close contact with each other to prevent flow out of liquid from container 4001. A concave 4024 is provided in rubber member 4021 at the inner surface of container 4001. Plug member 4031 fits into concave 4024.

By pulling out isolation film 4003, plug member 4031 fits into concave 4024, as shown in FIG. 4. This ensures the prevention of leakage of the liquid in container 4001.

The reason why the ink exhaustion detecting liquid and ink are separated by isolation film 4003 is to prevent displacement of the ink and the ink exhaustion detecting liquid in container 4001 irrespective of which side the ink cartridge is up during transportation. Management of the ink cartridge is facilitated because the position relationship between ink and the ink exhaustion detecting liquid is held in a fixed manner at the beginning of using an ink cartridge.

Figure 5:
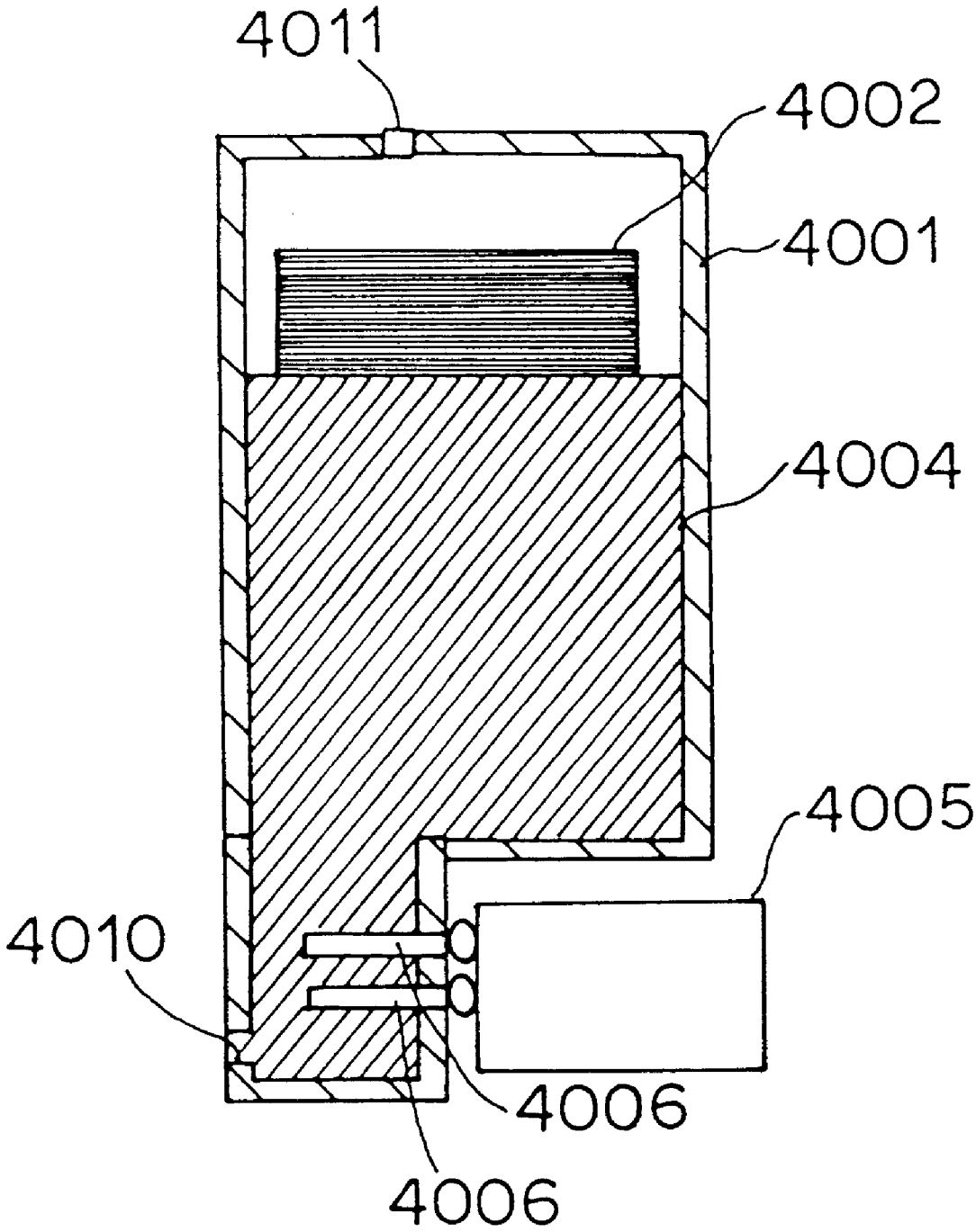
FIG. 5 is a sectional view of an ink cartridge at the start of its usage.

FIG. 5 is a sectional view of an ink cartridge at the start of usage thereof. By pulling out isolation film 4003 outwards from container 4001 as shown in FIGS. 3 and 4, ink exhausting detecting liquid permeable sponge 4002 can be brought into contact with ink permeable sponge 4004 as shown in FIG. 5. FIG. 5 omits the illustration of isolation film 4003.

Figure 6:
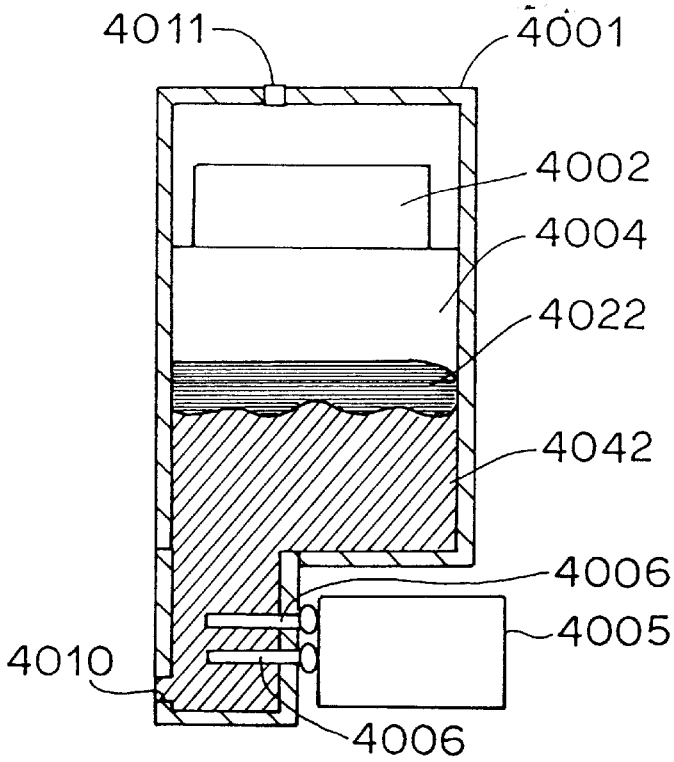
FIG. 6 is a sectional view of an ink cartridge when ink is slightly reduced.

FIG. 6 is a sectional view of the ink cartridge in which ink is decreased to a certain degree. In accordance with decrease of ink 4042 in container 4001, ink exhaustion detecting liquid 4022 moves downwards. As a result, sponge 4002 will be exhausted of the ink exhaustion detecting liquid. Also, the upper portion of ink permeable sponge 4004 is no longer impregnated with ink 4042 due to the downward flow of ink. The ink exhaustion detecting liquid 4022 of low specific gravity is floating on ink 4042.

Figure 7:
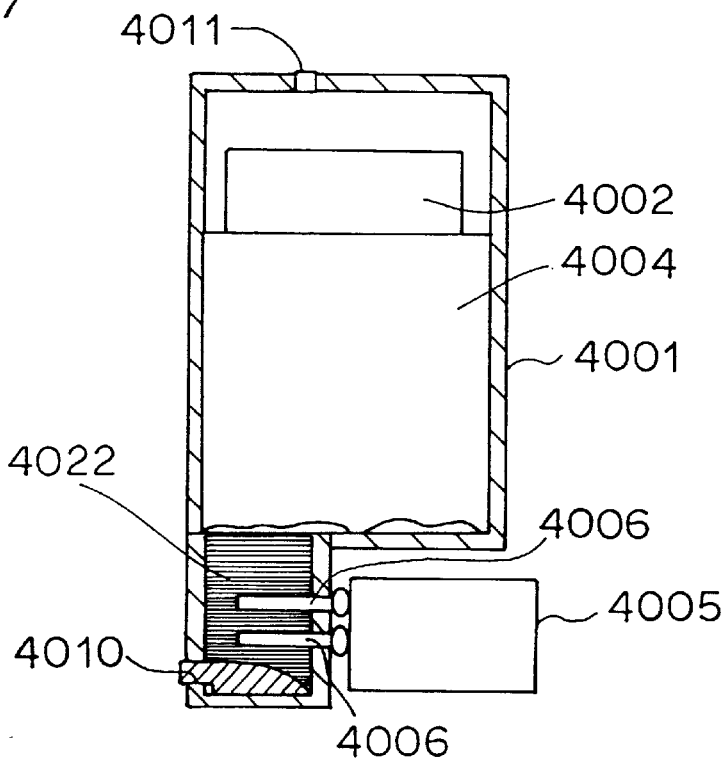
FIG. 7 is a sectional view of an ink cartridge when ink is exhausted.

FIG. 7 is a sectional view of the ink cartridge in which ink is exhausted. When the supply of ink is low, the lower portion of ink permeable sponge 4004 is impregnated with ink exhaustion detecting liquid 4022. The electrical resistance between electrodes 4006 increases, whereby ink exhaustion is detected by ink exhaustion detection circuit 4005.

Ink and the ink exhaustion detection liquid will be described in detail hereinafter. Ink exhaustion detecting liquid includes a fluidized material of low viscosity. The ink exhaustion detecting liquid is, for example, oil-based and has a specific gravity lower than that of ink. The print ink is water-based, and has a specific gravity greater than that of the ink exhaustion detecting liquid. According to such difference in property, ink and the ink exhaustion detecting liquid are not miscible with each other and moves downwards maintaining the upper and lower relationship.

The oil-based ink exhaustion detecting liquid has insulation with high resistance, whereas the water-based ink has conductivity. Therefore, decrease in the amount of ink can be detected by the change in the measured resistance of electrodes 4006.

For the print ink, a liquid with a solvent of water and ethylene glycol (specific gravity approximately 1.0) is used. For the ink exhaustion detecting liquid, perilla oil (specific gravity 0.93–0.94) or soybean oil (specific gravity 0.91–0.92) is used. This liquid may be substituted with other appropriate fluidized substance.

The present invention is not limited to the first embodiment in which an ink exhaustion detecting liquid was impregnated in a porous member. The ink exhaustion detecting liquid may be accommodated in an appropriate container and replace the ink in the ink permeable sponge by piercing a hole externally from the container.

Electrodes 4006 serving as ink exhaustion detection sensors may not necessarily be provided at the lower portion of the container and may be provided external of ink supply hole 4010.

According to the ink cartridge described in the first embodiment, an effect as set forth in the following is obtained. Ink exhaustion can be reliably detected since an ink exhaustion detecting liquid not miscible with ink and having electrical resistance different from that of ink is used to surround the electrodes when the supply of ink is low. The usage of an ink exhaustion detecting liquid having electrical resistance different from that of ink allows a smaller spacing between the electrodes. Therefore, reduction in size and weight of the apparatus can be achieved. Even in the case where a porous member is accommodated in a container with the porous member located between the electrodes, reduction of the amount of ink can be reliably detected since the ink permeable porous member is completely substituted with the ink exhaustion detecting liquid.

Second Embodiment

An ink cartridge according to a second embodiment of the present invention will be described hereinafter.

Figure 8:
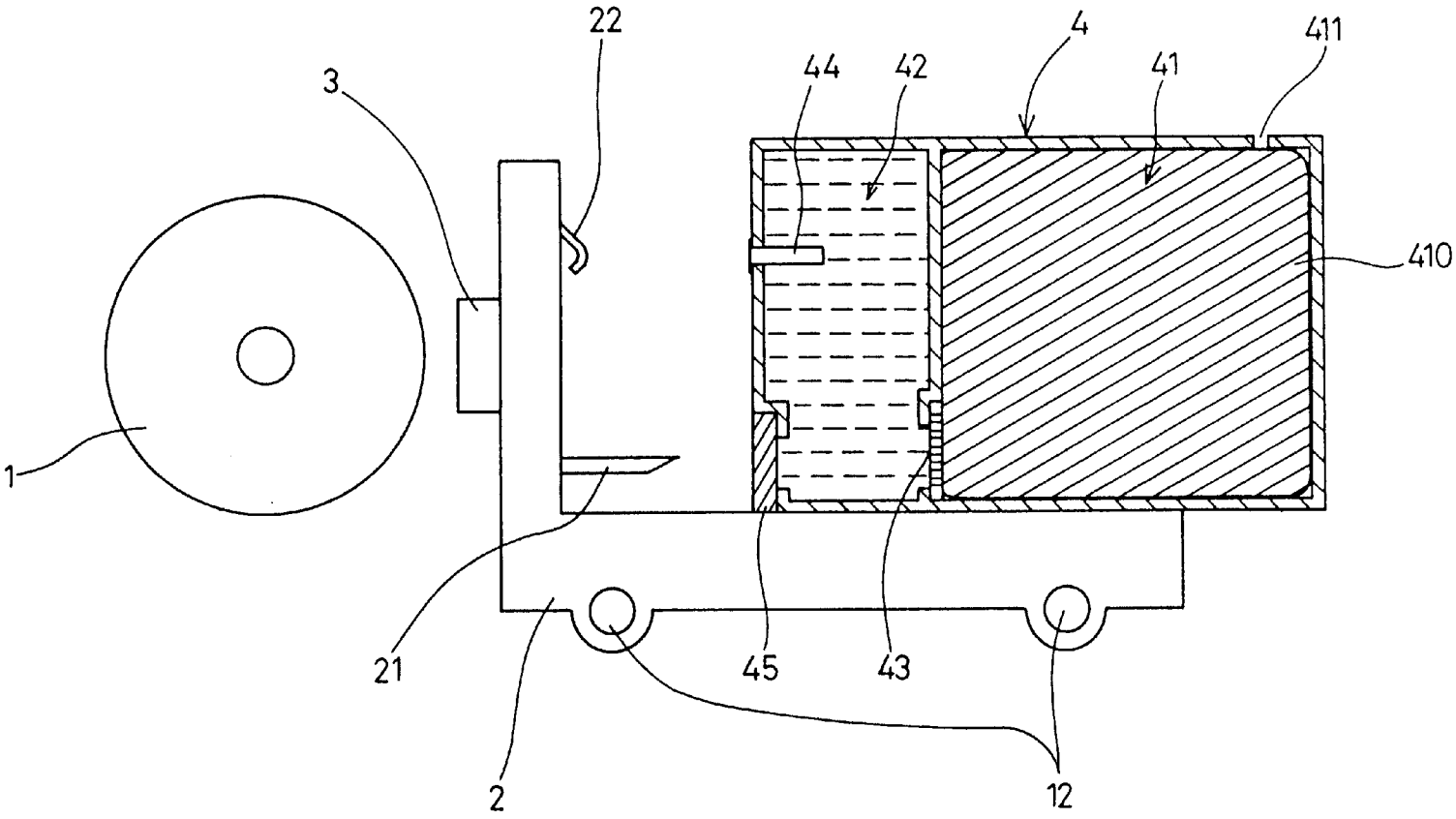
FIG. 8 is a partial sectional side view in the proximity of a carriage in which an ink cartridge according to a second embodiment is not yet attached.

FIG. 8 is a partial sectional view in the proximity of a carriage 2 in which an ink cartridge is not yet loaded. Ink cartridge 4 has a box configuration. The interior is divided into an ink permeable chamber 41 and an ink chamber 42 by a partition wall.

An ink permeable material 410 of a porous material such as polyurethane foam is accommodated in ink permeable chamber 41. An air vent hole 411 is provided at the upper wall of ink permeable chamber 41 for introducing external air therein at the time of reduction of the amount of ink in ink permeable chamber 41.

The partition wall between ink permeable chamber 41 and ink chamber 42 has an opening at a lower portion thereof. A communicating member 43 having a plurality of microholes is provided at the opening. Ink permeable chamber 41 communicates with ink chamber 42 through the microholes of communicating member 43. Elements 41 and 42 form for example a storage means.

At the upper portion of the sidewall of ink chamber 42 opposite to the partition wall, a rod electrode 44 is provided protruding at a predetermined length inwards of ink chamber 42 therethrough. The base end portion of electrode 44 partially protrudes outwards of the sidewall. The sidewall provided with electrode 44 has an opening at a lower portion thereof. A rubber elastic body 45 is fixed at the opening.

Carriage 2 has a vertical wall portion at one end of a plate-like base portion, showing a L-shape viewed sectionally. Carriage 2 is provided with the wall portion facing the side of platen roller 1.

Carriage 2 is provided with a print head 3 at the platen roller side plane of the wall portion. At the opposite plane of the wall portion, a terminal 22 for forming contact with electrode 44, and a hollow needle electrode 21 which goes through elastic body 45 are provided.

Hollow needle electrode 21 serves as a needle for drawing out ink from ink chamber 42 and also as an electrode for detecting the remaining amount of ink. Terminal 22 is provided at the upper portion of the wall portion and hollow needle electrode 21 is provided at the lower portion of the wall portion.

Figure 9:
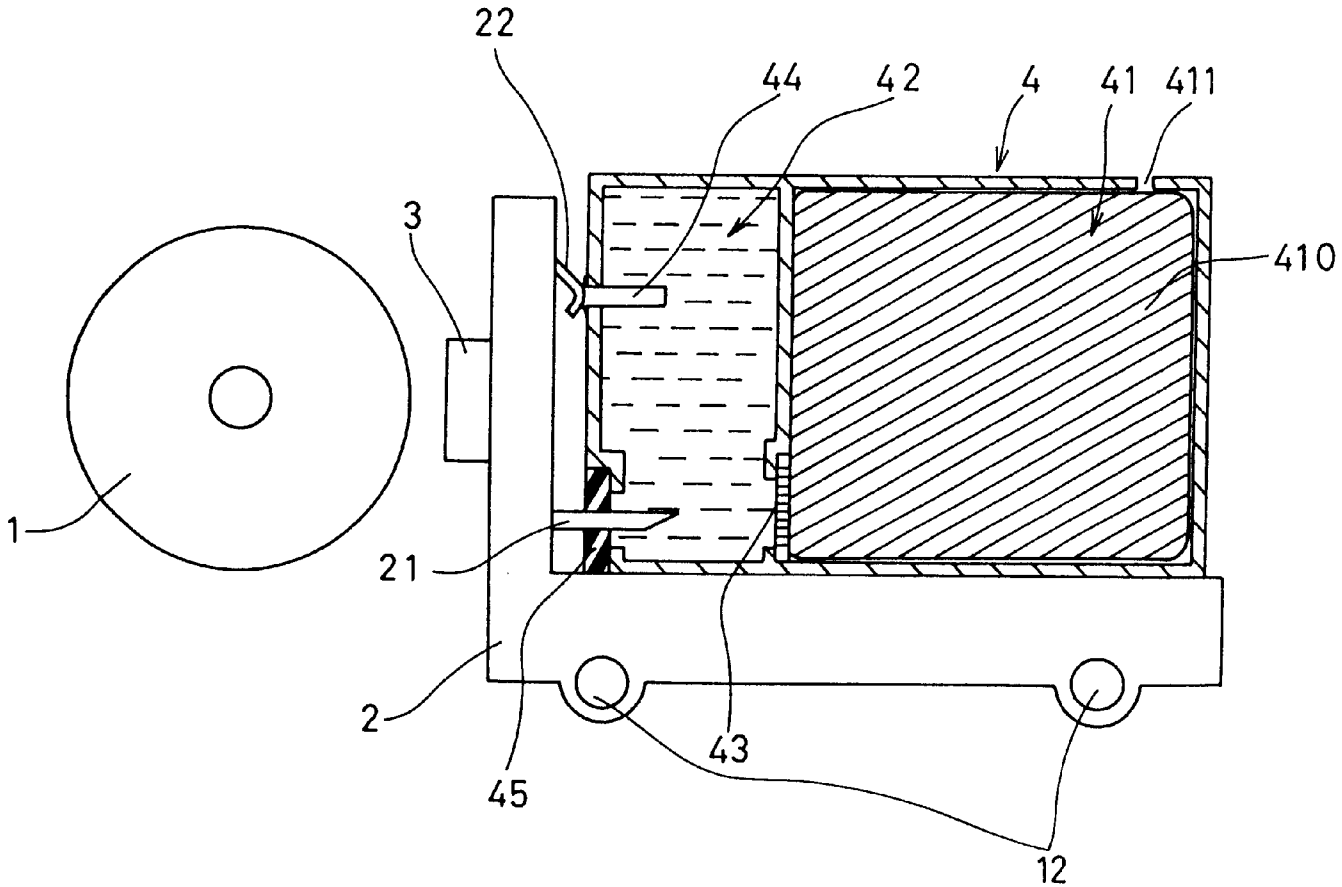
FIG. 9 is a partial sectional side view in the proximity of a carriage in which an ink cartridge is attached.

FIG. 9 is a partial sectional side view in the proximity of carriage 2 with ink cartridge 4 loaded. Ink cartridge 4 is loaded so that the base end portion of electrode 44 is in contact with terminal 22, and hollow needle 21 penetrates elastic body 45. By loading ink cartridge 4 on carriage 2 in the above-described manner, the ink in ink chamber 42 is drawn out into carriage 2 via hollow needle 21. The extracted ink is provided to print head 3 to be sprayed towards a print paper wound up around platen roller 1.

As ink in ink chamber 42 is discharged, the ink permeated into ink permeable material 410 in ink permeable chamber 41 is supplied to ink chamber 42 through the microholes of communicating member 43, whereby ink is replenished in ink chamber 42. As ink in ink permeable chamber 41 gradually decreases, air enters ink permeable chamber 41 through air vent hole 411, whereby air intrudes into ink permeable material 410.

Figure 10:
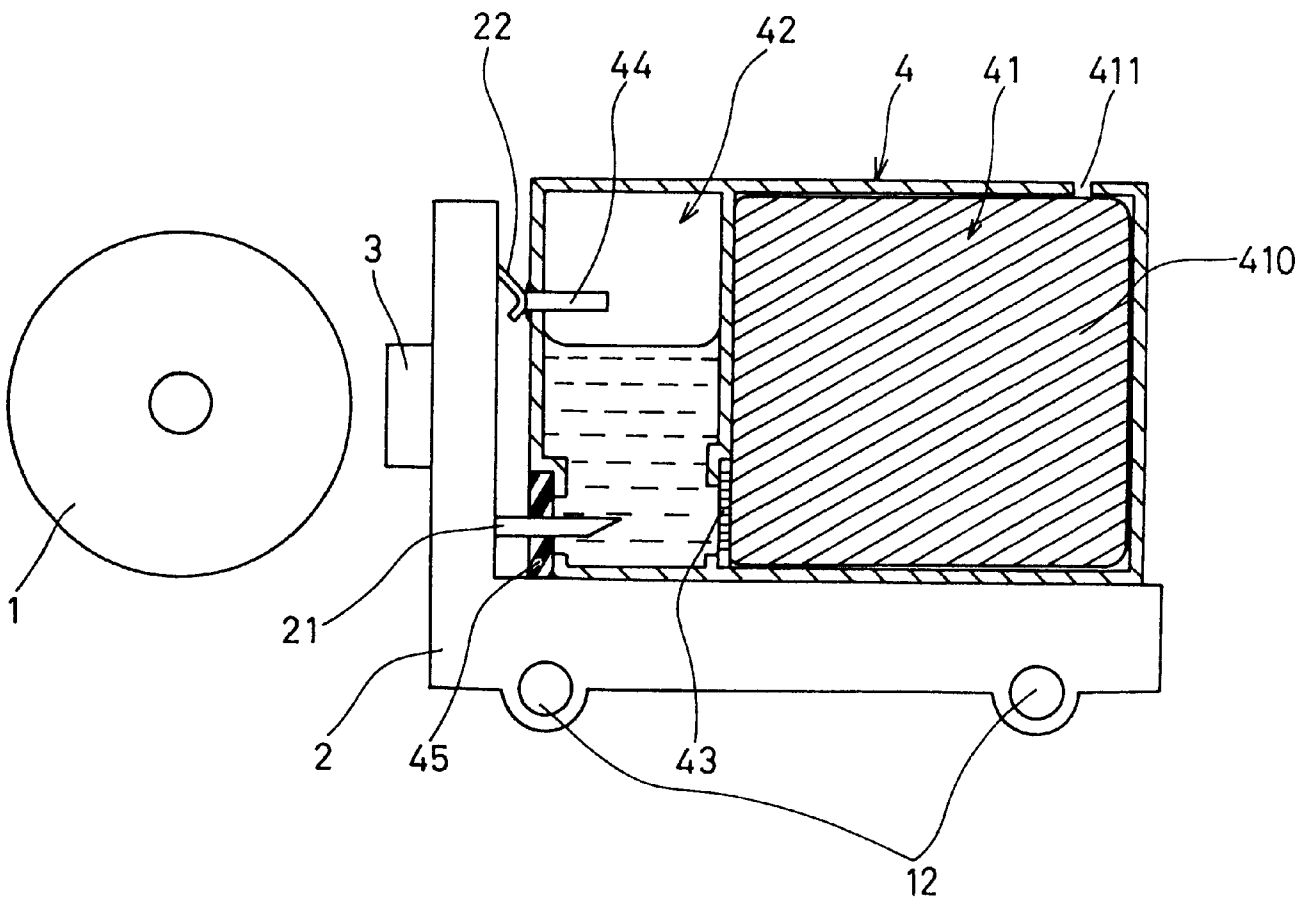
FIG. 10 is a partial sectional side view in the proximity of a carriage in which the remaining amount of ink in an ink cartridge is extremely low.

When ink in ink permeable chamber 41 comes to a very low level, the air in ink permeable material 410 passes through the microholes of communicating member 43 into ink chamber 42. In accordance with introduction of air in ink chamber 42, the amount of ink decreases, whereby the liquid surface of ink becomes lower. FIG. 10 is a partial sectional side view in the proximity of carriage 2 in which the remaining amount of ink in ink cartridge 4 is extremely low. In contrast to the case shown in FIG. 9 where ink chamber 42 is filled with ink, FIG. 10 shows electrode 44 exposed from the surface of ink in ink chamber 42 when the remaining amount of ink is extremely low.

Figure 11:
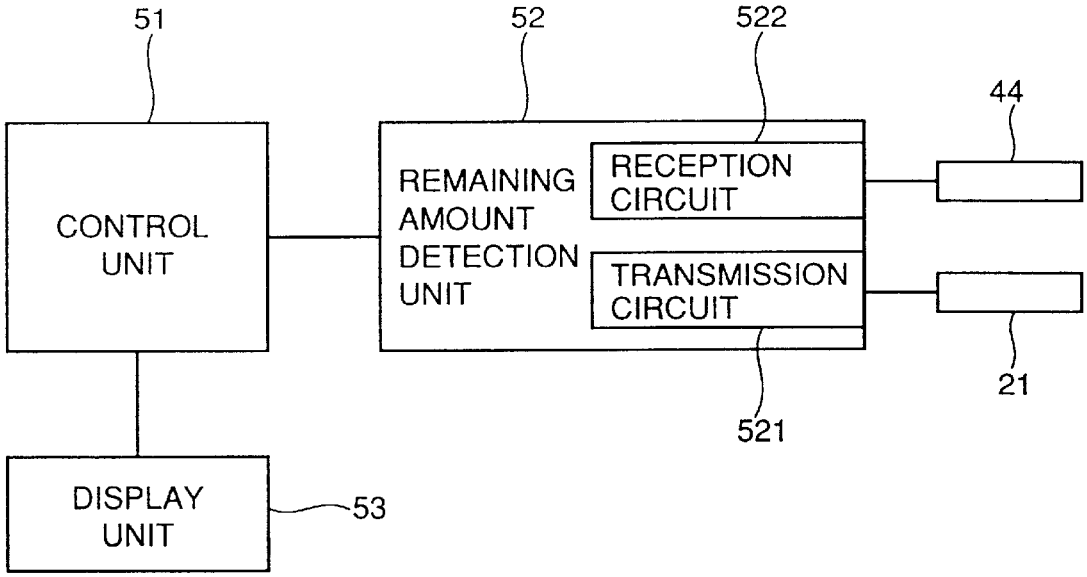
FIG. 11 is a block diagram showing an entire structure of an ink remaining amount detection system.

The structure of an ink remaining amount detecting system for detecting the remaining amount of ink in ink cartridge 4 will be described hereinafter. FIG. 11 is a block diagram showing an entire structure of an ink remaining amount detecting system. Referring to FIG. 11, a control unit 51 is connected to a remaining amount detection unit 52 formed of circuitry for detecting the remaining amount of ink, and to a display unit 53 for informing that the remaining amount of ink has come below a predetermined value. Remaining amount detection unit 52 includes a transmission circuit 521 for transmitting a pulse signal for detection of the remaining amount of ink, and a reception circuit 522 for receiving a pulse signal. Transmission circuit 521 is connected to hollow needle electrode 21, and reception circuit 522 is connected to electrode 44 via terminal 22.

Remaining amount detection unit 52 detects the remaining amount of ink by detecting the state of conduction between electrode 44 and hollow needle electrode 21. Information representing the detected result is applied to control unit 51. In control unit 51, determination is made whether the remaining amount of ink in cartridge 4 comes below a predetermined value (a remaining amount of an extremely low level) according to the detected information provided from remaining amount detection unit 52. When determination is made that the remaining amount of ink is below a predetermined value, information is applied to display unit 53 to provide a display indicating that the remaining amount of ink has come below a predetermined value. Display unit 53 includes display means such an ink error lamp. When display information is provided from control unit 51, display unit 53 indicates that the remaining amount of ink is extremely low by turning on an ink error lamp or the like.

FIGS. 12(*a*) and 12(*b*) are circuit diagrams showing structures of transmission circuit 521 and reception circuit 522 of remaining amount detection unit 52.

The structure of transmission circuit 521 will first be described. A resistor 5214 and a capacitor 5213 are connected in series between a power supply node N5 receiving power supply potential and an output node N2 connected to hollow needle electrode 21 (refer to FIG. 9). A driver 5211 and a resistor 5212 are connected in series between an input node N1 receiving a pulse signal of a predetermined frequency and the node between resistor 5214 and capacitor 5213.

The structure of reception circuit 5222 is as follows. Resistors 5222 and 5223 are connected in series between power supply node N5 and a ground node N6 receiving ground potential. A capacitor 5221 is connected between an input node N3 connected to electrode 44 (referred to FIG. 9) and a node N4. A capacitor 5224 is connected between input node N4 and ground node N6. Node N4 is connected to the input terminal of the negative side of a comparator 5227. Resistors 5225 and 5226 are connected in series between power supply node N5 and ground node N6. The input terminal of the positive side of comparator 5227 is connected to a node between resistors 5225 and 5226.

A resistor 5229 and a capacitor 5220 are connected in series between power supply node N5 and node N6. A resistor 5228 is connected between a node N7 (output node) between resistor 5229 and capacitor 5220 and the output terminal of comparator 5227.

The operations of transmission circuit 521 and reception circuit 522 will be described hereinafter. FIG. 13 is a waveform diagram of signals of respective nodes in transmission circuit 521 and reception circuit 522 in remaining amount detection unit 52. In FIG. 13, (a), (b), and (c) show signal waveforms of input node N1, node N4, and output node N7, respectively. The operations of transmission circuit 521 and reception circuit 522 will be described hereinafter with reference to FIGS. 12 and 13.

The input node of transmission circuit 521 is applied with a pulse signal of a predetermined frequency, as shown by FIG. 13(*a*). Transmission circuit 521 has a charge and discharge circuit formed by driver 521, resistors 5212 and 5214, and capacitor 5213. In response to an input pulse signal, charge and discharge of capacitor 5213 is carried out. As a result of charging and discharging, a pulse signal output (for example, 0–5V) appears at output node N2.

When ink cartridge 4 is mounted to carriage 2 with ink chamber 42 filled with ink as shown in FIG. 9, there is ink between electrode 44 and hollow needle electrode 21. Because ink has conductivity, the presence of ink between electrode 44 and hollow needle electrode 21 provides conduction by resistance of ink between electrodes 44 and 21. Therefore, in reception circuit 522, a pulse signal according to a pulse signal of input node N2 appears at input node N3.

When ink cartridge 4 is not mounted as shown in FIG. 8 or there is no ink between electrode 44 and hollow needle electrode 21 due to an extremely low supply of remaining ink, the potential of node N4 in reception circuit 522 is maintained at ½ the power supply potential (for example 2.5V) as shown in FIG. 13(*b*), where the power supply potential is resistance-divided by resistors 5222 and 5223.

In reception circuit 522, a charge and discharge circuit is formed by resistors 5222 and 5223, and capacitor 5221. Charging and discharging of capacitor 5221 is carried out in response to a pulse signal appearing on input node N3. As a result of charging and discharging, a pulse signal output appears at node N4.

Since the reference potential of node N4 is ½ the power supply potential, the pulse signal appearing at node N4 has an amplitude centering on that potential as shown in FIG. 13(*b*). This pulse signal is the input potential of the negative input terminal of comparator 5227.

The input potential of the positive input terminal of comparator 5227 is maintained at a potential (for example, 3.4V) higher than ½ the power supply potential by resistance-dividing the power supply potential with resistors 5225 and 5226. Comparator 5227 provides an output signal of a high level and a low level when the input potential of the negative input terminal is lower and higher, respectively, than the input potential of the positive input terminal.

At the output side of comparator 5227, a charge and discharge circuit is formed by resistor 5229, capacitor 5220 and resistor 5228. This charge and discharge circuit has resistor 5229 and capacitor 5220 functioning as a charging circuit, and capacitor 5220, resistor 5228, and the output transistor of comparator 5227 functioning as a discharging circuit. Because comparator 5227 has an open collector structure, the charging and discharging operations take a long period and a short period, respectively.

In this charge and discharge circuit, charge and discharge of capacitor 5220 is carried out in response to an output signal of comparator 5227. This charge and discharge circuit is repeatedly switched to a discharging state during a charging state when the output signal of comparator 5227 changes in response to the pulse signal shown in FIG. 13(*b*), since the charging takes a long time period and discharging a short time period. As shown in FIG. 13(*c*), when the remaining amount of ink exceeds a predetermined value, the output potential of output node N7 is maintained at a low level (for example, 0V), otherwise to a high level (for example, 5V).

The output signal of reception circuit 522 is applied to control unit 51 (refer to FIG. 11). When the level of the output signal provided from reception circuit 522 attains a high level, control unit 51 makes determination that the remaining amount of ink in ink cartridge 4 is lower than a predetermined value. Conversely, if the level of the output signal attains a low level, determination is made that the remaining amount of ink in ink cartridge 4 is not yet lower than a predetermined value. This means that there is sufficient amount of ink remaining in the cartridge.

Figure 14:
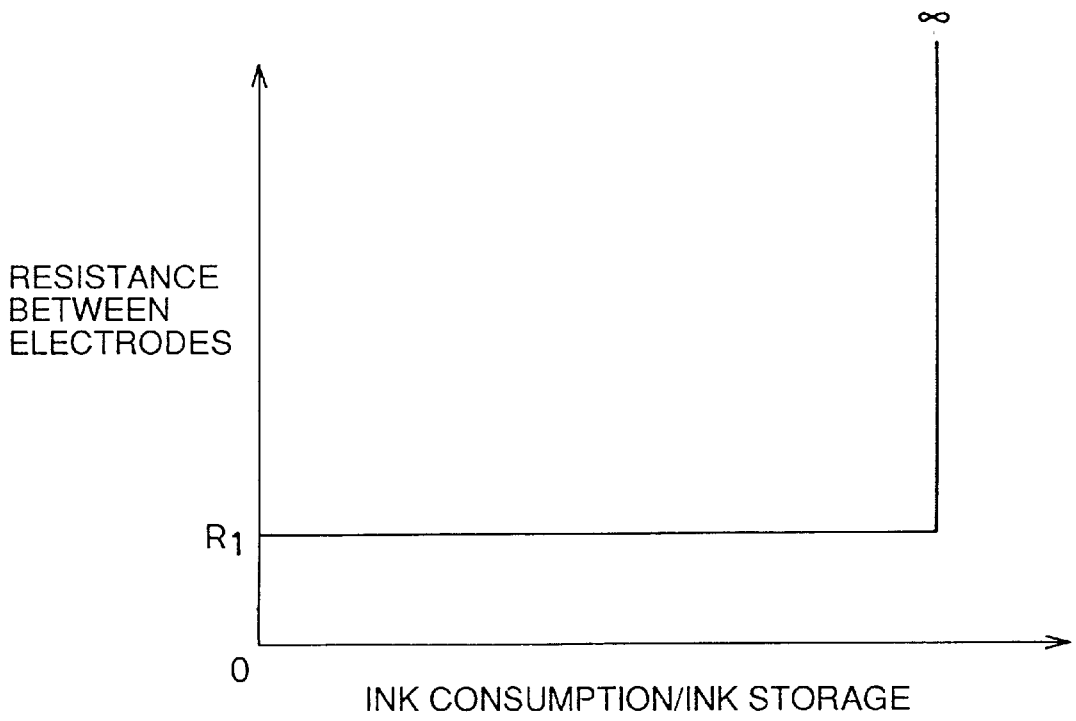
FIG. 14 is a graph showing the relationship between the remaining amount of ink and resistance between electrodes in an ink cartridge.

FIG. 14 is a graph showing the relationship between the remaining amount of ink in ink cartridge 4 and the resistance between electrode 44 and hollow needle electrode 21. The resistance value across the electrodes is plotted along the ordinate, and the ratio of ink consumption to ink capacity (consumed amount of ink/ink capacity) which is data representing the remaining amount of ink is plotted along the abscissa.

It is appreciated from FIG. 14 that, as long as there is a sufficient amount of ink in the ink cartridge with electrodes 44 and 21 submerged in the liquid of ink of ink chamber 42, the resistance value indicates a constant resistance of R irrespective of the amount of ink due to conduction across these electrodes. As the remaining amount of ink decreases due to consumption of ink, so that electrode 44 is completely exposed from ink in ink chamber 42, conduction across the electrodes is no longer developed. When the remaining amount of ink becomes lower than a certain level, the resistance value becomes infinite in a step-graded manner.

Because the resistance across electrode 44 and hollow needle electrode 21 increases infinitely in a step-graded manner at the boundary of a certain level, the detection result of remaining amount detection unit 5 is very high in precision.

The remaining amount information control carried out in control unit 51 will be described hereinafter for informing that the remaining amount of ink in ink cartridge 4 has become lower than a predetermined level or that ink cartridge 4 is not loaded.

Figure 15:
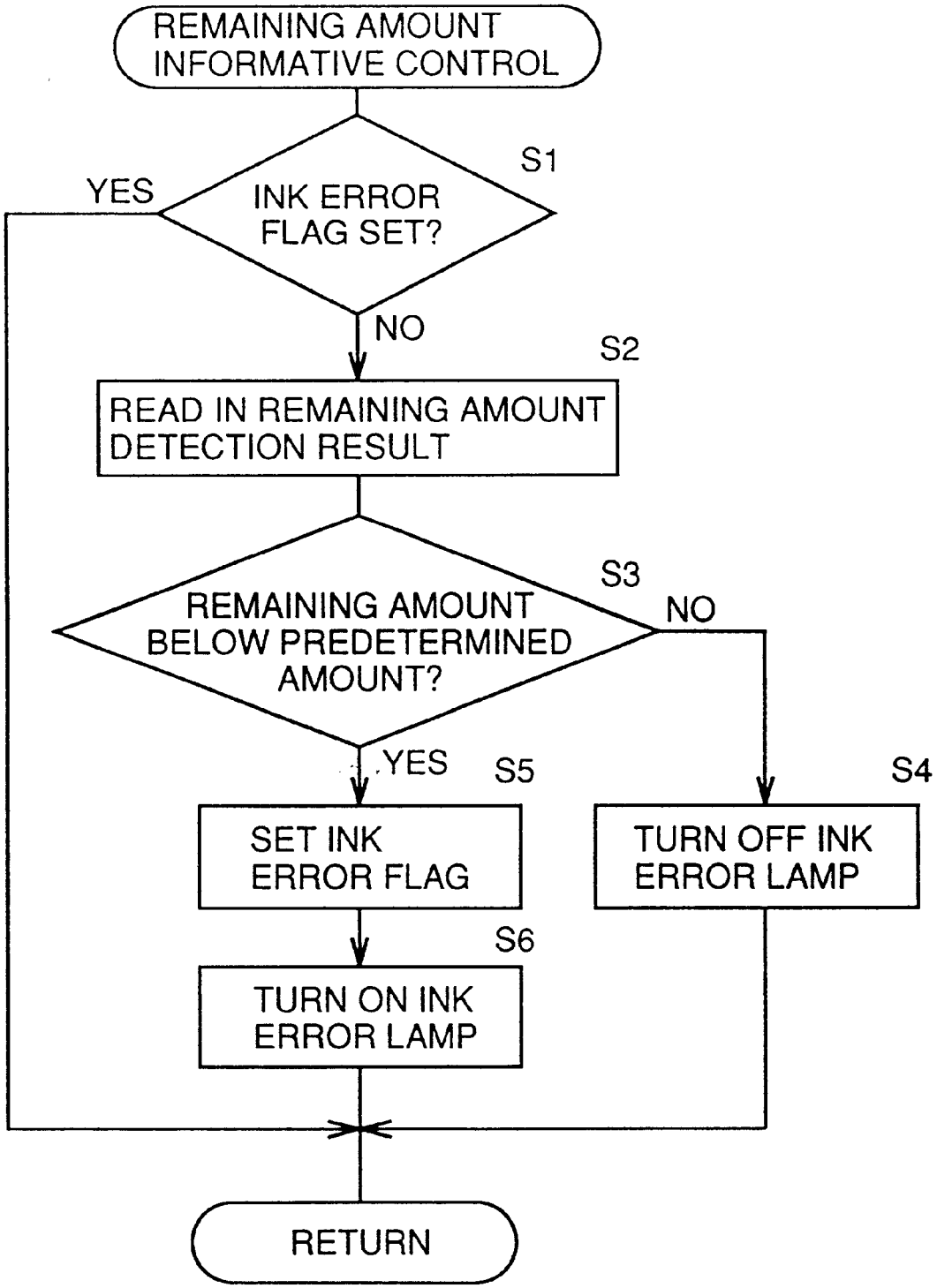
FIG. 15 is a flow chart of the remaining amount information control.

In control unit 51, remaining amount information control is carried out according to a subroutine program executed by a main routine controlling the main operation of the ink jet printer. FIG. 15 is a remaining amount information control flow chart.

At step S1, determination is made whether an ink error flag is set or not. An ink error flag serves to inform that the remaining amount of ink in ink cartridge 4 has become lower than a predetermined amount or that ink cartridge 4 is not loaded. This ink error flag is set at a step S5 which will be described later. The ink error flag is reset as the power of the ink jet printer is turned on. It is also reset by operating a clear switch which is a mechanical switch provided at a predetermined position.

At step S2, the detection result of the remaining amount of ink is read from remaining amount detection unit 52. At step S3, determination is made whether the remaining amount of ink is below a predetermined amount according to the detection result read in at step S2. This determination is carried out according to the level of the signal representing the remaining amount detection result provided from remaining amount detection unit 52.

When determination is made that the remaining amount of ink is not below a predetermined value at step S3 (when the detection signal attains a low level), control proceeds to step S4. When determination is made that the remaining amount of ink is below a predetermined amount (when the detection signal attains a high level), the control proceeds to step S5.

At step S4, the ink error flag in display unit 53 is turned off, and the control returns to the main routine. At step S5, the ink error flag is set, and control proceeds to step S6. This ink error flag set at step S6 is not reset after the power of the ink jet printer is turned on, provided that the aforementioned clear switch is not operated. At step S6, the ink error lamp is turned on, and control returns to the main routine.

According to such a remaining amount information control, the occurrence of the remaining amount of ink coming below a predetermined amount or an ink cartridge 4 not yet loaded is notified by the ink error lamp in display unit 53 being turned on appropriately. The user is made aware of the exchange time of an ink cartridge 4 or whether an ink cartridge 4 is not loaded by display unit 53.

Thus, the detection accuracy of the remaining amount of ink can be improved without making complicated the structure of the apparatus according to the ink jet printer of the second embodiment.

Third Embodiment

Figure 16:
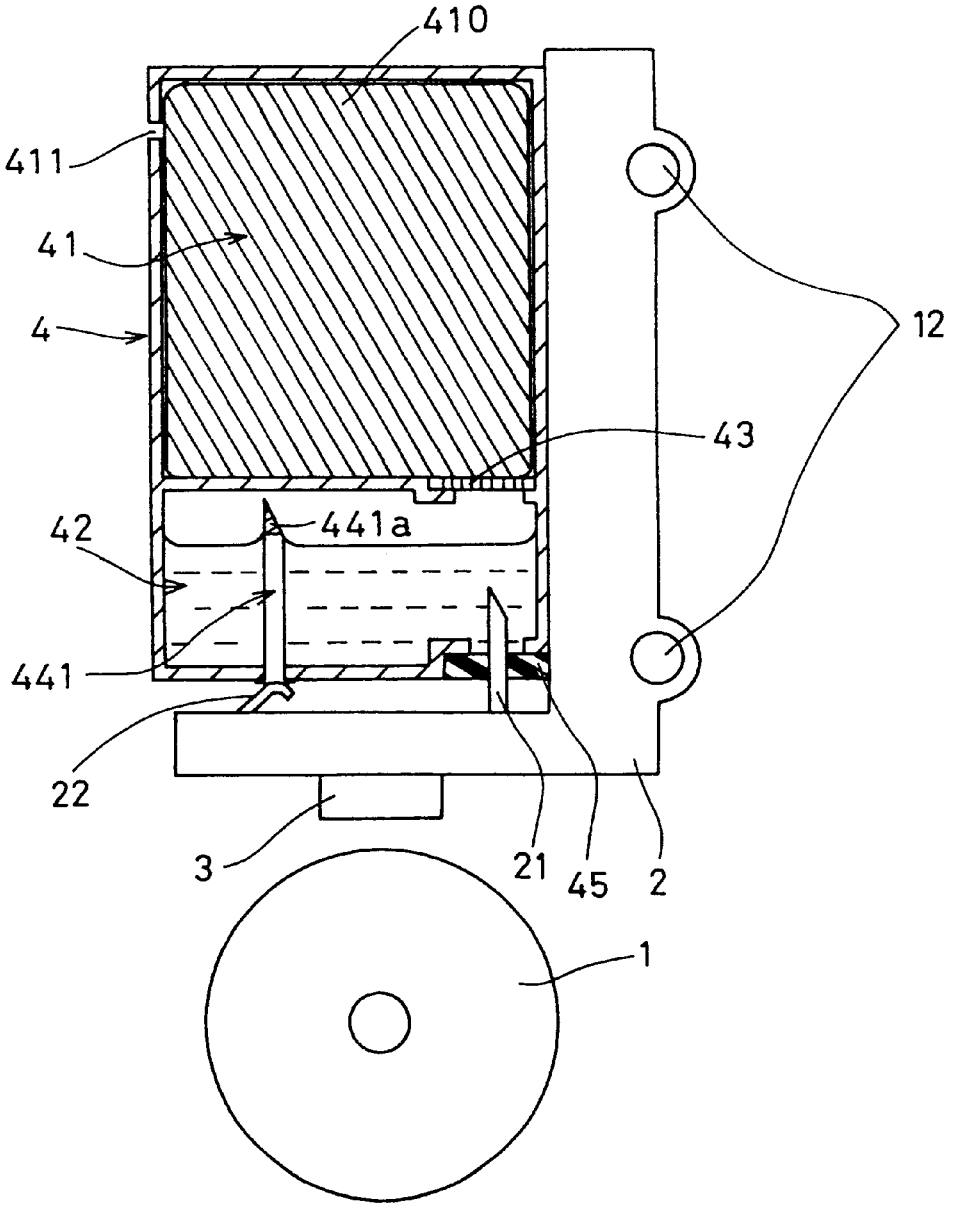
FIG. 16 is a partial sectional side view in the proximity of a carriage having an ink carriage of an ink jet printer attached according to a third embodiment.

A third embodiment of the present invention will be described hereinafter. An ink jet printer may be operated with print head 3 positioned above a platen roller 1 according to the type of transportation means of the printing paper. A structure of an ink cartridge 4 allowing detection of the remaining amount of ink in such a case is disclosed in the present third embodiment. FIG. 16 is a partially sectional side view in the proximity of a carriage 2 having ink carriage 4 of an ink jet printer of the second embodiment loaded. FIG. 16 shows the case where print head 3 is used in a manner located above platen roller 1. In FIG. 16, components corresponding to those in FIG. 9 have the same reference characters denoted, and their description will not be repeated.

FIG. 16 differs from FIG. 9 in the structure of an electrode 441. Electrode 441 corresponds to electrode 44 of FIG. 8. Electrode 441 is provided in ink chamber 42 so as to be in parallel with hollow needle electrode 21. An insulation process is applied on the surface of electrode 441 except for the tip portion 441*a*. Electrode 441 has a length greater than that of hollow needle electrode 21 so that the tip is located closer to the ink permeable chamber 41 than that of hollow needle electrode 21.

Detection of the remaining amount of ink is carried out by a detecting system of a structure identical to that shown in FIG. 11 in the ink jet printer using ink cartridge 4 of FIG. 16.

The operation of the ink jet printer of FIG. 16 will be described hereinafter. When the ink jet printer of FIG. 16 is operated with carriage 2 and ink cartridge 4 disposed horizontal (sideways) to platen roller 1 as shown in FIG. 9 (referred to as horizontal disposed state), ink decreases in the manner shown in FIG. 10, whereby detection of the remaining amount of ink is carried out as in the second embodiment.

When the ink jet printer of FIG. 16 has print head 3 located above platen roller 1, i.e. when the ink jet printer is operated with carriage 2 and ink cartridge 4 disposed vertically as in the figure (referred to as a vertical disposed state), the surface of ink moves from edge portion 441*a* of electrode 441 towards the base portion according to decrease of the remaining amount of ink.

When the supply of ink in ink chamber 42 becomes lower, the tip end 441*a* of electrode 441 is exposed prior to the exposure of the tip of hollow needle electrode 21 in ink chamber 42.

When tip end portion 441*a* of electrode 441 is exposed due to decrease of the remaining amount of ink, conduction across electrode 441 and hollow needle electrode 21 is no longer developed, whereby detection is allowed of the remaining amount of ink becoming lower than a predetermined level.

The ink jet printer of the third embodiment allows accurate detection of the remaining amount of ink even when the locations of carriage 2 and ink cartridge 4 are changed.

Fourth Embodiment

A fourth embodiment of the present invention will be described hereinafter. The fourth embodiment shows another example of detecting the remaining amount of ink when the ink jet printer is operated with carriage 2 and ink cartridge 4 disposed in a vertical manner, as in the third embodiment.

Figure 17:
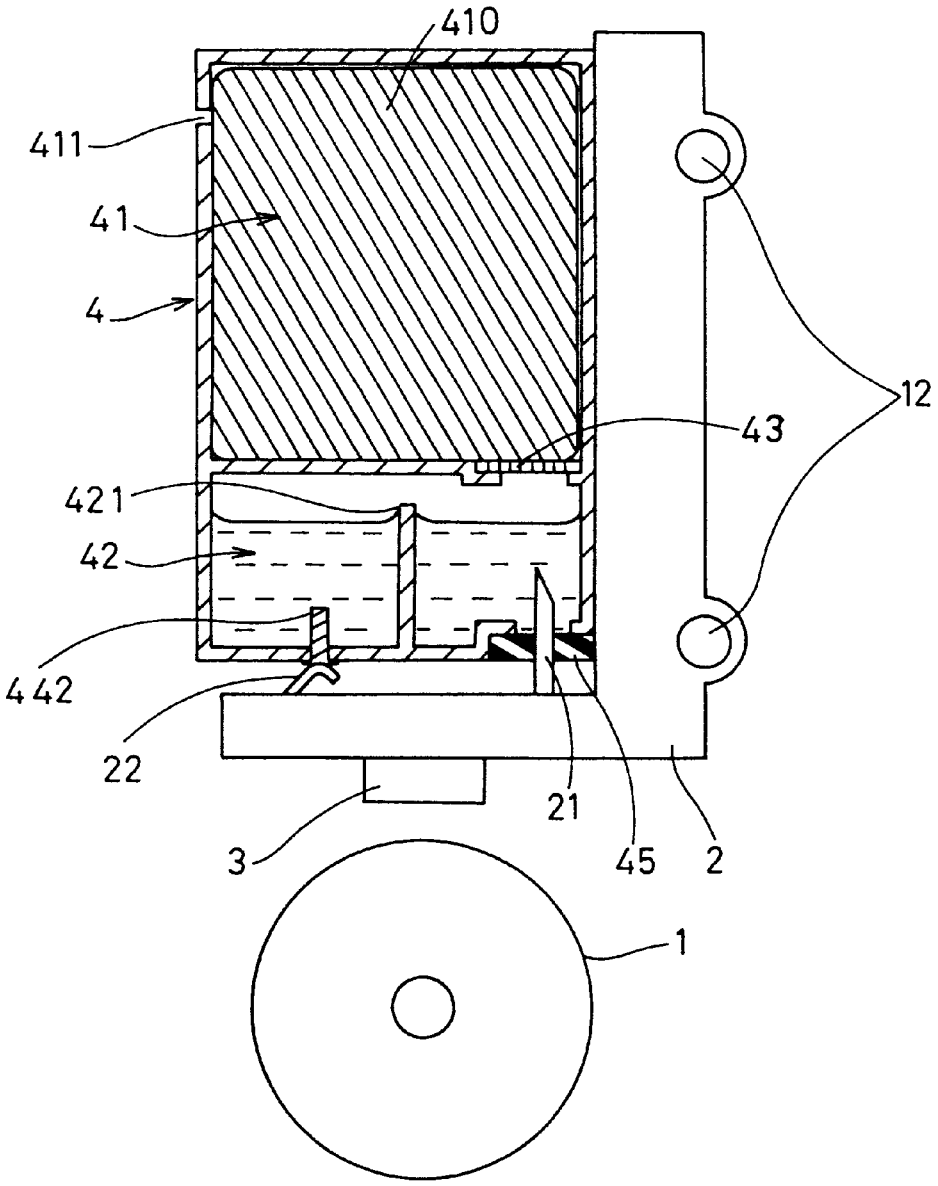
FIG. 17 is a partial sectional side view in the proximity of a carriage having an ink cartridge attached of an ink jet printer according to a fourth embodiment.

FIG. 17 is a partial sectional side view in the proximity of carriage 2 with ink cartridge 4 loaded in an ink jet printer according to the fourth embodiment. FIG. 17 particularly shows the state where print head 3 is located above platen roller 1. The components in FIG. 17 corresponding to those of FIG. 16 have the same reference character denoted, and their description will not be repeated. FIG. 17 differs from FIG. 16 in an electrode 442 provided in ink chamber 42 and a division wall 421. Electrode 442 corresponds to electrode 441 of FIG. 16, and is provided in ink chamber 42 in parallel with hollow needle electrode 21. The length of electrode 442 in ink chamber 42 is equal to that of hollow needle electrode 21.

Division wall 421 is provided between electrode 442 and hollow needle electrode 21 in ink chamber 42. Division wall 421 has a level of height in a direction from the sidewall in which electrode 442 is provided towards the partition wall between ink permeable chamber 41 and ink chamber 42. The height thereof is higher than the tips of electrode 442 and hollow needle electrode 21 in ink chamber 42. More specifically, division wall 421 separates electrode 442 from hollow needle electrode 21 with a predetermined level of height.

The ink jet printer with ink cartridge 4 shown in FIG. 17 carries out detection of the remaining amount of ink by a detection system of a structure similar to that shown in FIG. 11.

The operation of the ink jet printer of FIG. 17 will be described hereinafter. When the ink jet printer of FIG. 17 is operated in a horizontal disposed state, electrode 442 is exposed prior to hollow needle electrode 21 upon reduction of the amount of ink. As a result, conduction between electrode 442 and hollow needle electrode 21 will no longer be developed, whereby detection is made that the remaining amount of ink has become lower than a predetermined amount.

When the ink jet printer of FIG. 17 is operated in a vertical disposed state, the ink surface moves in a direction towards the sidewall of ink chamber 42 in which electrode 442 is provided from the partition wall between ink permeable chamber 41 and ink chamber 42.

When the amount of ink in ink chamber 42 becomes lower than a predetermined amount, ink will be divided into the electrode 442 side and the hollow needle electrode 21 side by the division wall 421. When the ink in ink chamber 42 is divided by division wall 421 according to decrease of the ink, conduction between electrode 442 and hollow needle electrode 21 will no longer be developed, whereby detection can be made that the remaining amount of ink has become lower than a predetermined amount.

Thus, the ink jet printer of the fourth embodiment can carry out accurate detection of the remaining amount of ink even when the disposition of carriage 2 and ink cartridge 4 are altered.

Fifth Embodiment

A fifth embodiment of the present invention will be described hereinafter. Similar to the above-described third and fourth embodiments, the fifth embodiment can carried out detection of the remaining amount of ink even when the ink jet printer is operated with carriage 2 and ink cartridge 4 disposed vertically.

Figure 18:
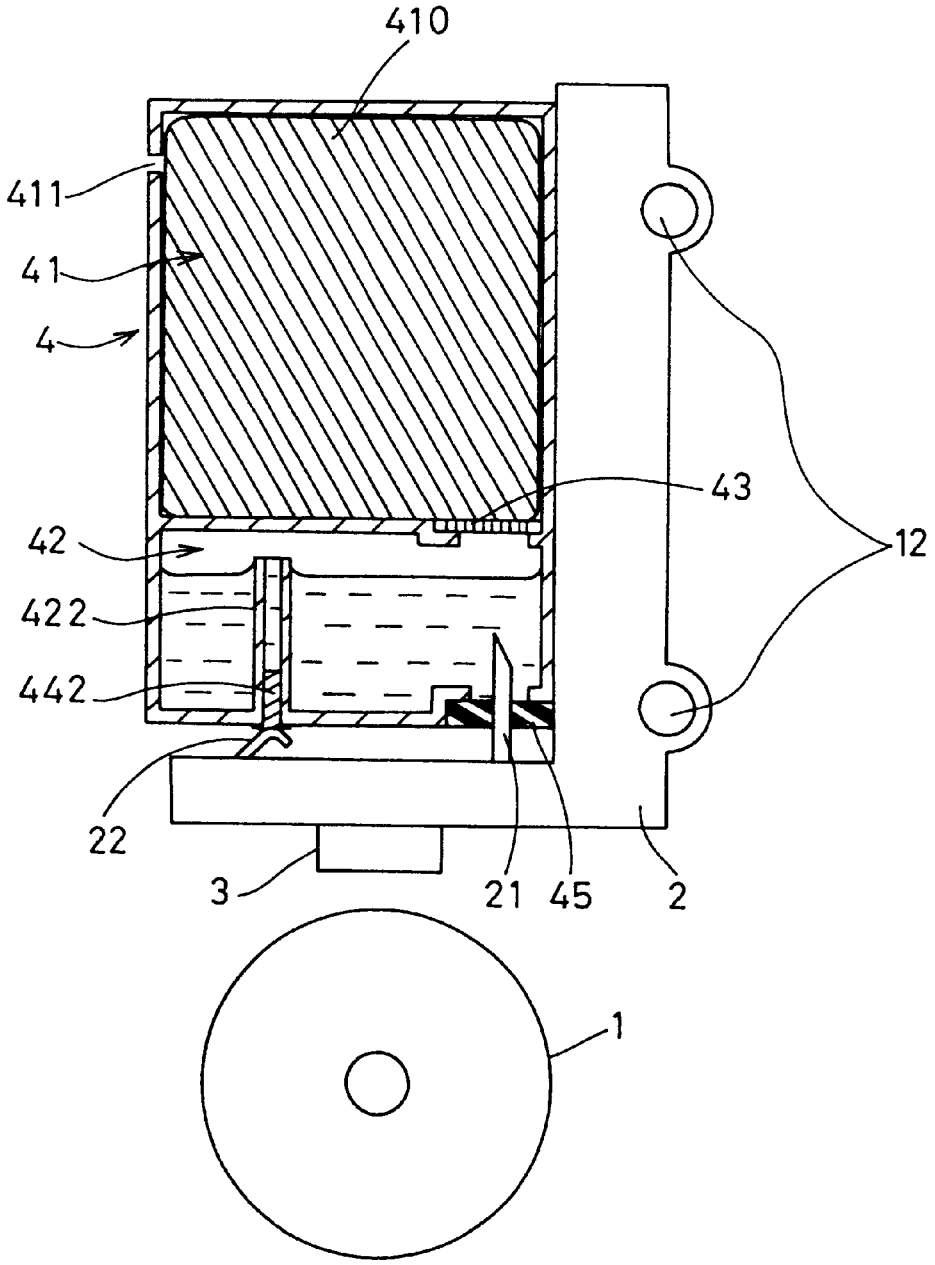
FIG. 18 is a partial sectional side view in the proximity of a carriage having an ink cartridge attached of an ink jet printer according to a fifth embodiment.

FIG. 18 is a partial sectional side view in the proximity of carriage 2 having ink cartridge 4 loaded of an ink jet printer according to the fifth embodiment. FIG. 18 shows the case where print head 3 is used in a manner located above platen roller 1. In FIG. 18, the components corresponding to those in FIG. 17 have the same reference characters denoted, and their description will not be repeated.

FIG. 18 differs from FIG. 17 in a sleeve 422 provided in ink chamber 42. Sleeve 422 has a function similar to that of division wall 421 of FIG. 17. Sleeve 422 is cylindrical and formed integral with the sidewall of ink chamber 42 in a manner where electrode 442 is inserted. Sleeve 422 is provided with a level of height in a direction from the sidewall where electrode 422 is provided towards the partition wall between ink permeable chamber 41 and ink chamber 42. The height thereof is higher than the tips of electrode 442 and hollow needle electrode 21, and equal to that of division wall 421 of FIG. 17. More specifically, sleeve 422 of a predetermined height separates electrode 422 from hollow needle electrode 421.

An ink jet printer with an ink cartridge 4 as shown in FIG. 18 carries out detection of the remaining amount of ink by a detection system of a structure identical to that of FIG. 11.

The operation of the ink jet printer of FIG. 18 will be described hereinafter. When the ink jet printer of FIG. 18 is operated in a horizontal disposed state, electrode 442 is exposed prior than hollow needle electrode 21 according to the decrease in the remaining amount of ink. As a result, conduction between electrode 442 and hollow needle electrode 21 will no longer be developed, whereby detection is made that the remaining amount of ink is below a predetermined amount.

When the ink jet printer of FIG. 18 is operated under a vertical disposed state, the surface of ink moves towards the sidewall of ink chamber 42 in which electrode 442 is provided from the partition wall between ink permeable chamber 41 and ink chamber 42 as shown in the figure.

When ink in ink chamber 42 becomes lower than a predetermined amount, the ink is divided into an inner portion and an outer portion of sleeve 422. When the ink in ink chamber 42 is divided by sleeve 422 according to decrease of ink, connection between electrode 422 and hollow needle electrode 21 is no longer developed, whereby detection can be made that the remaining amount of ink has become lower than a predetermined amount.

Thus, the ink jet printer of this embodiment can carry out precise detection of the remaining amount of ink even when the disposition of carriage 2 and ink cartridge 4 is altered. Although the structure of ink cartridge 4 of the fifth embodiment is slightly more complex than that of ink cartridge 4 of the fourth embodiment, it can provide detection of the remaining amount of ink more reliable than that of the ink jet printer of the fourth embodiment particularly in the case where ink chamber 42 has a relatively great volume of ink chamber 42 and the undulation of the ink surface is great due to a scanning operation of carriage 2.

The present invention is not limited to the fifth embodiment in which sleeve 422 is provided at the electrode 442 side in ink chamber 42, but may be provided at a portion where hollow needle electrode 21 is to be inserted.

Sixth Embodiment

Sleeve 422 provided in ink cartridge 4 of the fifth embodiment includes a gap inside the tip thereof. Therefore, there is a possibility that bubbles will be introduced or precipitated in the gap accidentally or due to change in temperature of the ink cartridge or charge in atmospheric temperature even through there is of a full supply of ink in ink chamber 42. The presence of intruding bubbles or precipitating bubbles in sleeve 442 will cause disruption of the conduction between electrode 442 and hollow needle electrode 21 regardless of the supply of ink in ink chamber 42. Therefore, there is a possibility of erroneous detection of the remaining amount of ink.

Although the bubbles in sleeve 422 may naturally travel outside from sleeve 422, this possibility is low since the ink has a great surface tension when ink cartridge 4 is reduced in size with sleeve 422 having a smaller diameter.

The sixth embodiment shows a partial improvement of ink cartridge 4 of the fifth embodiment in order to prevent intrusion or precipitation of bubbles into sleeve 422.

Figure 19:
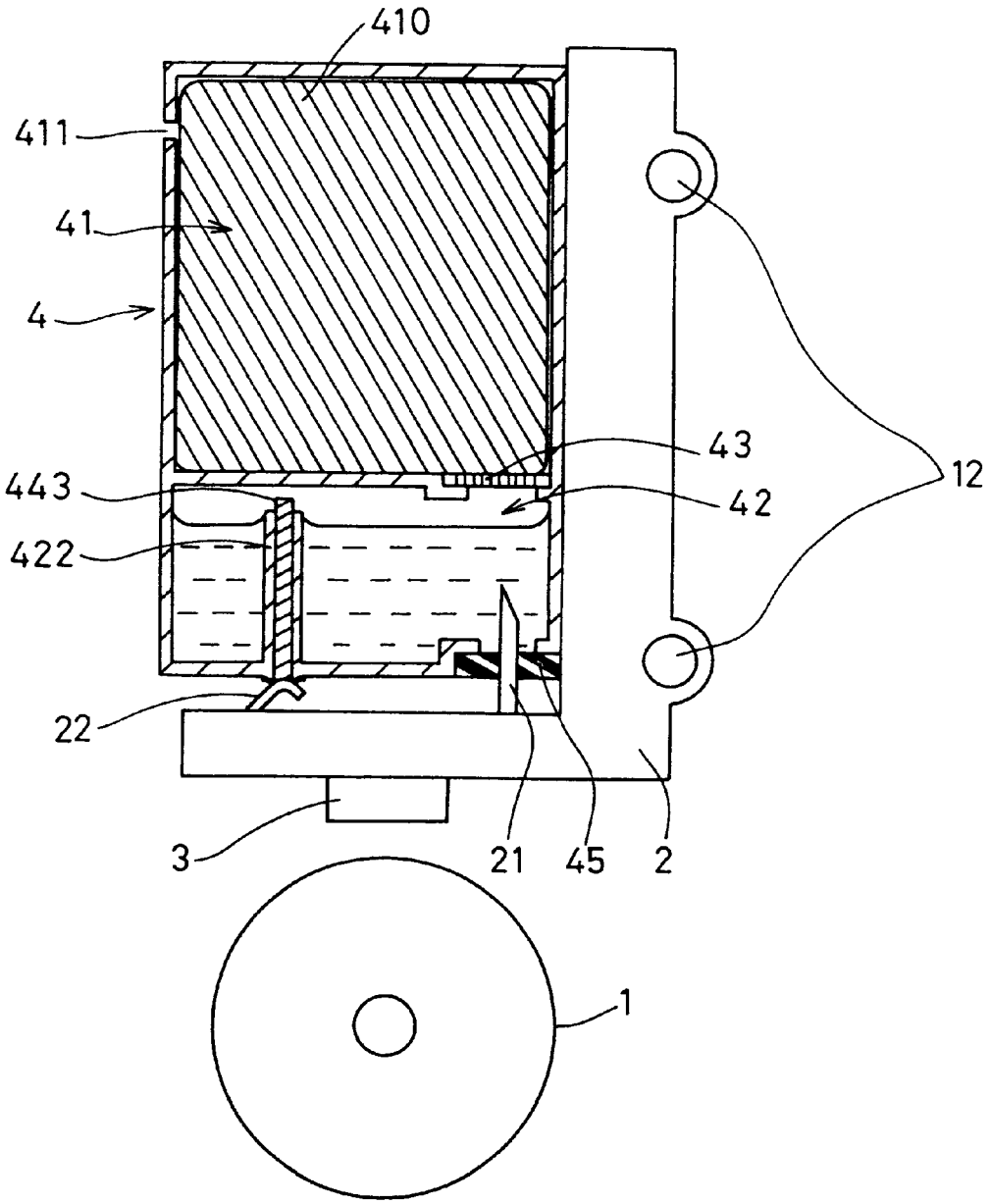
FIG. 19 is a partial sectional side view in the proximity of a carriage having an ink cartridge attached of an ink jet printer according to a sixth embodiment.

FIG. 19 is a partial sectional side view in the proximity of carriage 2 having ink cartridge 4 loaded in an ink jet printer according to a sixth embodiment. FIG. 19 particularly shows the case where print head 3 is located above platen roller 1. In FIG. 19, components corresponding to those of FIG. 18 have the same reference characters denoted, and their description will not be repeated.

FIG. 19 differs from FIG. 18 in electrode 443. Electrode 443 corresponds to electrode 442 of FIG. 18. Electrode 443 has a length greater than the length of sleeve 442. Therefore, electrode 443 has its tip end protruding outwards from an opening of sleeve 442 in ink chamber 42.

According to the above-described structure, the ink jet printer of FIG. 19 does not include a gap or spacing where bubbles will be introduced or precipitated inside sleeve 422. Therefore, the aforementioned erroneous detection of the remaining amount of ink will not occur since there is no possibility of air in sleeve 422.

Seventh Embodiment

Figure 20:
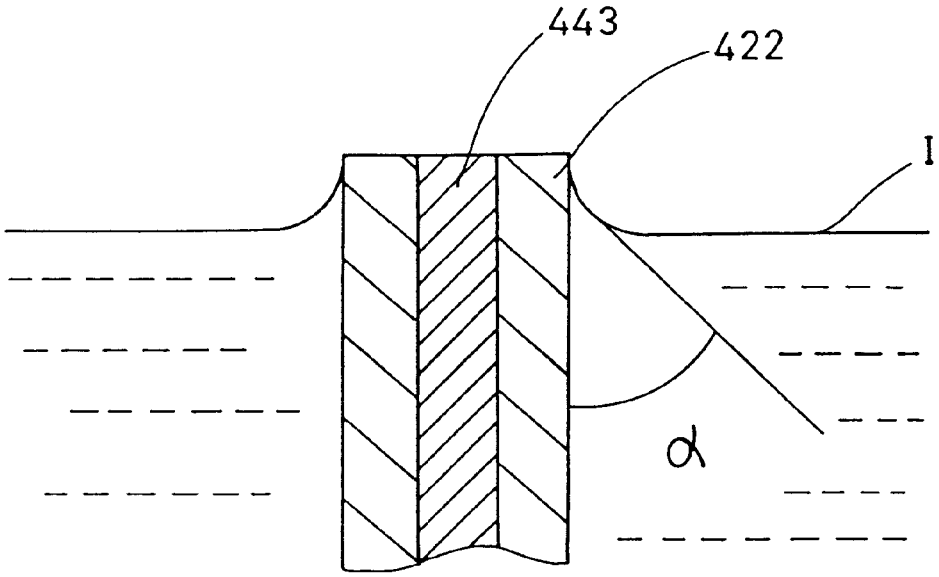
FIG. 20 is a schematical enlarged sectional view showing a sleeve of an ink cartridge according to a sixth embodiment.

FIG. 20 is an schematical enlarged sectional view of sleeve 422 in the proximity of sleeve 422 shown in the sixth embodiment.

Referring to FIG. 20, the tip of sleeve 422 provided in ink cartridge 4 of the sixth embodiment has a plane configuration. When ink surface I becomes lower than the position of the tip of sleeve 422 with carriage 2 and ink cartridge 4 disposed vertically, the ink will come into contact with sleeve 422 by a constant angle (referred to as "contact angle" hereinafter) $\alpha$ by its surface tension.

Therefore, ink surface I is raised in the proximity of sleeve 422. According to the ink level, ink surface I may be raised to the tip plane of sleeve 422 in the proximity thereof. This state will cause ink to form contact with electrode 443 by its surface tension regardless of whether the actual surface level of ink is lower than the end plane of sleeve 422.

This surface tension of ink will lead to a possibility of unreliable detection result of the remaining amount of ink in the ink jet printer of the sixth embodiment.

The present seventh embodiment is provided to suppress unreliable detection of the remaining amount of ink due to such ink surface tension. The seventh embodiment shows a partial improvement of sleeve 422 of the sixth embodiment.

Figure 21:
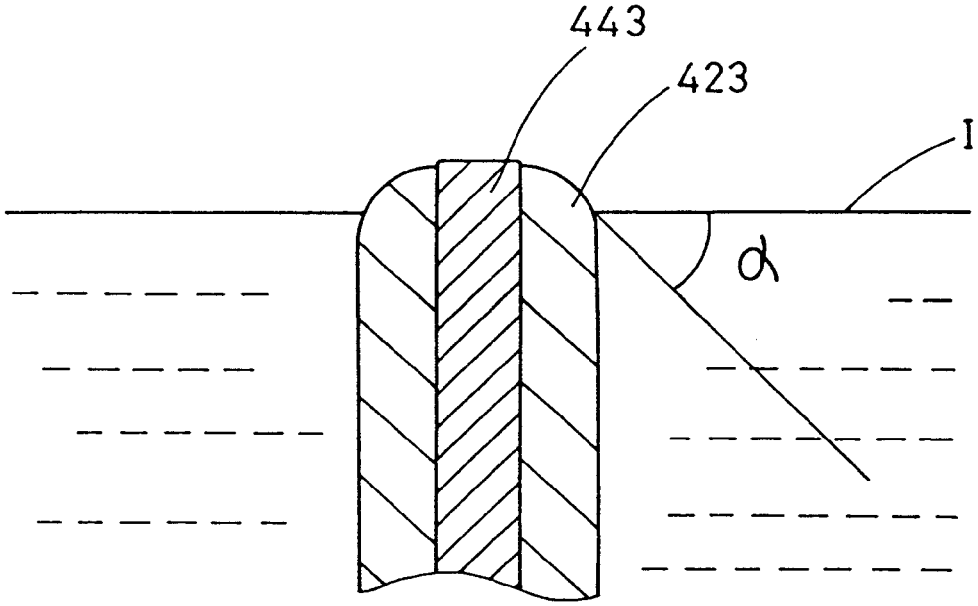
FIG. 21 is a schematical enlarged sectional view showing an example of a sleeve in an ink cartridge of an ink jet printer according to a seventh embodiment.
Figure 22:
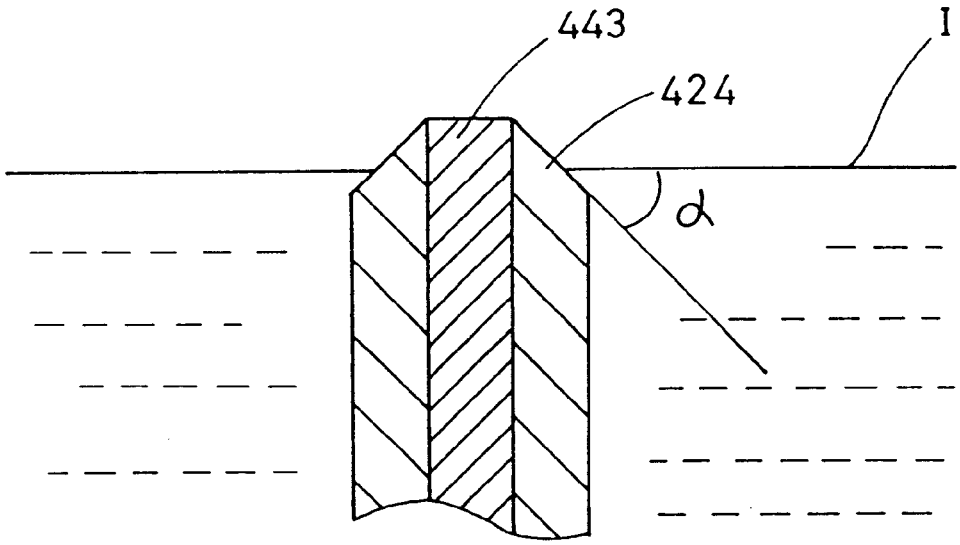
FIG. 22 is a schematic enlarged sectional view showing an example of a sleeve in an ink cartridge of an ink jet printer according to a seventh embodiment.

FIGS. 21 and 22 are enlarged sectional views of a sleeve in an ink cartridge according to an ink jet printer of the seventh embodiment.

Sleeve 423 of FIG. 21 corresponds to sleeve 422 of FIG. 19. Sleeve 423 has an end portion of a curved cross sectional configuration in which the outer diameter increases towards the base portion thereof.

Ink will not be raised to the position of the tip of electrode 443 despite the surface tension of ink when ink surface I becomes lower than the position of the tip of sleeve 423 owing to the configuration of sleeve 423.

Sleeve 424 of FIG. 22 also corresponds to sleeve 422 of FIG. 19. The tip of sleeve 424 has a linear cross sectional configuration in which its outer diameter increases towards the base portion thereof.

Ink will not be raised to the position of electrode 443 despite its surface tension of ink even when ink surface I becomes lower than the position of the tip of sleeve 424 due to its configuration thereof.

According to sleeves 423 and 424 shown in FIGS. 21 and 22, ambiguous detection of the remaining amount of ink caused by surface tension ink is suppressed.

Eighth Embodiment

Similar to the seventh embodiment, the eighth embodiment is a partial improvement of sleeve 422 of the sixth embodiment to eliminate ambiguity in the detection of the remaining amount of ink caused by surface tension of ink.

Figure 23:
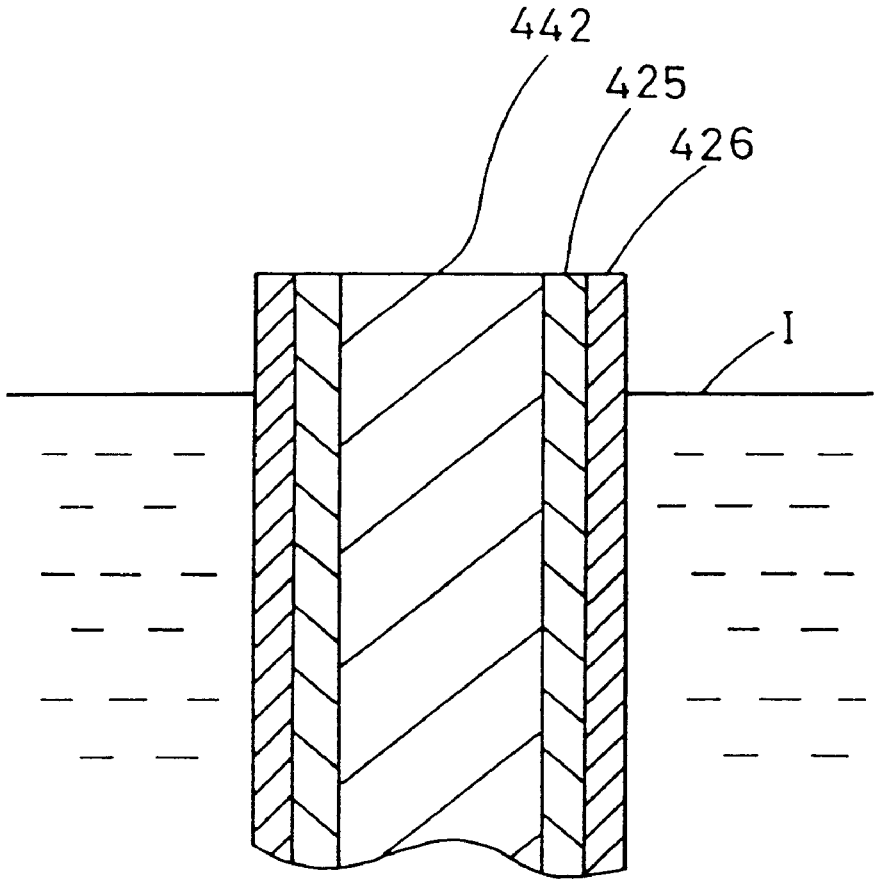
FIG. 23 is a schematic enlarged sectional view of an example of a sleeve in an ink cartridge of an ink jet printer according to an eighth embodiment.

FIG. 23 is an enlargement sectional view of a sleeve in an ink cartridge of an ink jet printer according to an eighth embodiment.

Sleeve 425 of FIG. 23 corresponds to sleeve 422 of FIG. 19. The end of sleeve 425 has a plane configuration similar to that of sleeve 422 of FIG. 19. The outer circumference of sleeve 425 is coated with a water repellent coating material 426 such as of silicone sealing material. The outer perimeter of sleeve 425 is subject to a water repellent process.

According to a sleeve 425 of the above-described structure, ink is repelled by water repellent coating material 426 regardless of the surface tension of ink when ink surface I becomes lower than the position of the tip of sleeve 425.

Ink will not be raised to the position of electrode 442, so that no contact will be formed between ink and electrode 442.

According to an ink jet printer loading an ink cartridge 4 provided with such a sleeve 425, obscurity of detection of the remaining amount of ink due to surface tension of ink is eliminated.

The present invention is not limited to the eighth embodiment in which a water repellent coating material 426 is coated on sleeve 425 to achieve a water repellent feature on sleeve 425, and sleeve 425 may be entirely formed of a water repellent material.

Ninth Embodiment

In practice, the ink jet printer described in the above second-eighth embodiments are reciprocatedly driven along a slight shaft 12 shown in FIG. 1. Such a reciprocating scanning operation will cause undulation of the ink surface in ink chamber 42. This undulation of the surface is significant at the transition from a forward scanning operation to a return scanning operation of carriage 2.

Figure 24:
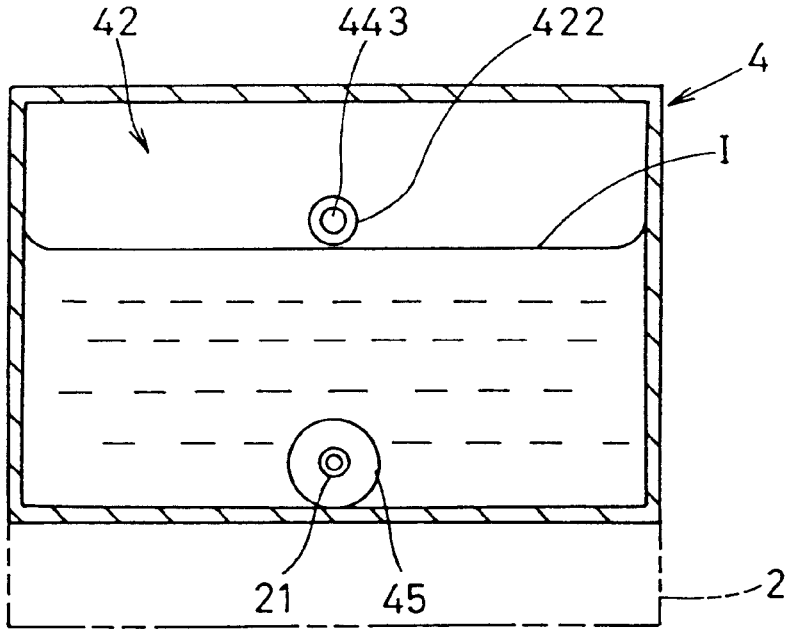
FIGS. 24 and 25 are schematic vertical sectional views of an ink chamber showing undulation states of the ink surface in the ink chamber due to reciprocating scanning of the carriage.
Figure 25:
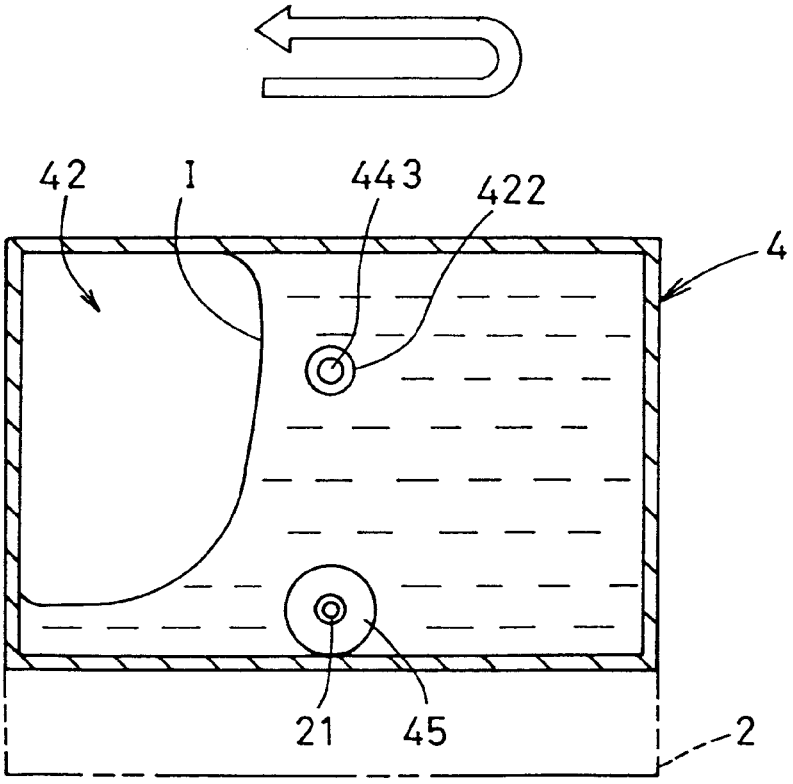

FIGS. 24 and 25 are schematic vertical sectional views of ink chamber 42 for describing undulation of the ink surface I due to a reciprocating scanning operation of carriage 2 in the case where carriage 2 and ink cartridge 4 are disposed horizontally. FIG. 24 shows a state where the ink surface does not undulate, and FIG. 25 shows the state where the ink surface is undulating.

When the remaining amount of ink decreases, ink surface I becomes lower in level, whereby electrode 443 is exposed as shown in FIG. 24. Therefore, conduction between electrode 443 and hollow needle electrode 21 is no longer developed. When carriage 2 takes a return operation in the direction of the open arrow shown in FIG. 25, ink surface I is undulated, leading to a possibility that the conduction between electrode 443 and hollow needle electrode 21 is developed. This state will result in an unreliable detection of the remaining amount of ink.

The ninth embodiment is an improvement of the shape of ink chamber 42 in order to obtain stable detection of the remaining amount of ink by suppressing the undulation of the ink surface.

Figure 26:
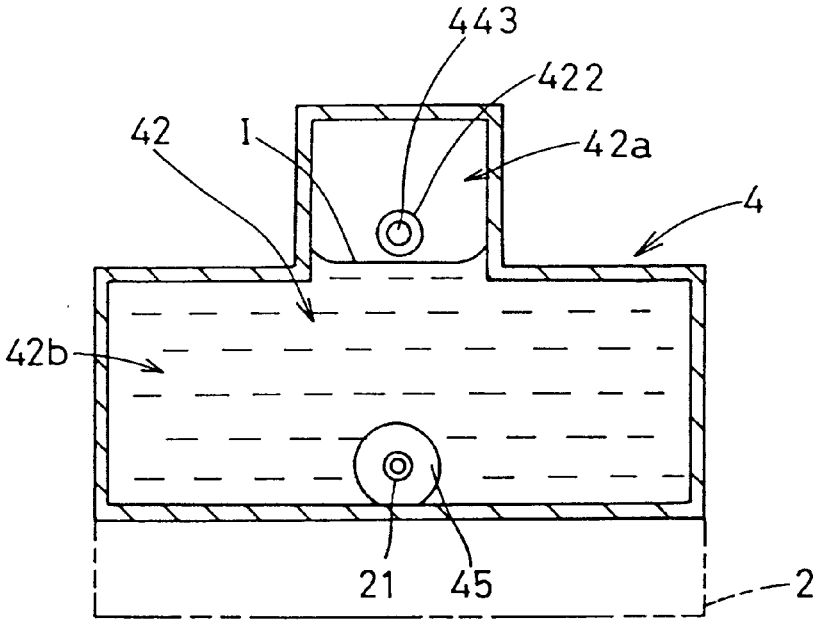
FIGS. 26 and 27 are schematic vertical sectional views of an ink chamber of an ink jet printer according to a ninth embodiment.
Figure 27:
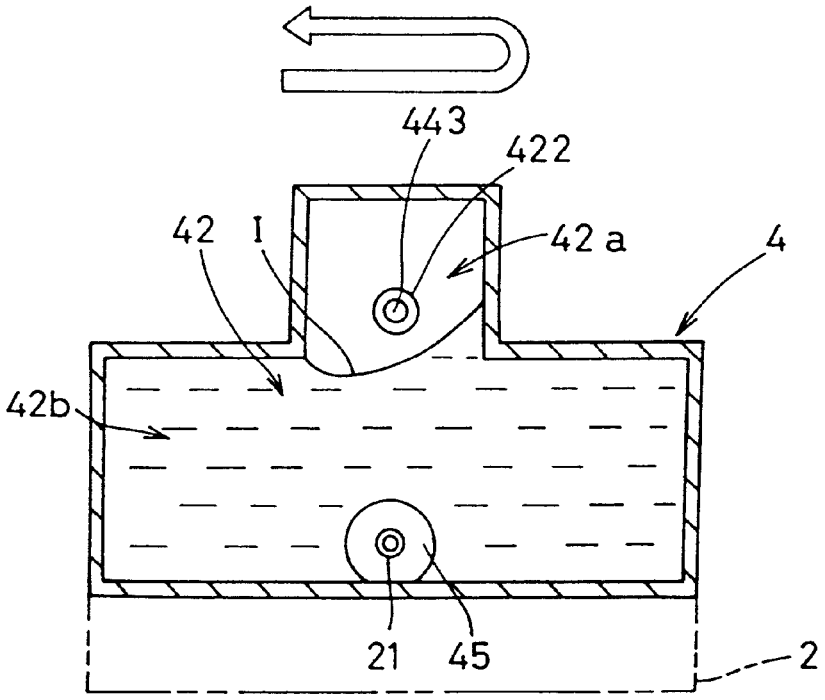

FIGS. 26 and 27 are vertical sectional views of an ink chamber according to an ink jet printer of the ninth embodiment. FIG. 26 shows a state where the ink surface is not undulated, and FIG. 27 shows a state where the ink surface is undulating.

As shown in FIGS. 26 and 27, ink chamber 42 has a cross section of a convex configuration. In the narrow area of the upper portion of the convex configuration (referred to as "the upper space" hereinafter) 42*a*, an electrode 443 is provided. Hollow needle electrode 21 is provided in the lower broad area (referred to as "the lower space" hereinafter) of the convex configuration.

According to ink chamber 42 of such a configuration, air intruding within ink chamber 42 caused by decrease of the remaining amount of ink remains in the upper space 42*a*. Air remaining at upper space 42*a* will not move towards the lower spacing 42*b* as long as there is no vertical movement of carriage 2. More specifically, undulation of ink surface I is small even when a reciprocating scanning operation of carriage 2 is carried out. The air accumulated at the upper space 42*a* will not migrate to lower space 42*b*. Stable detection of the remaining amount of ink can be carried out in an ink jet printer loaded with an ink cartridge 4 of the ninth embodiment since undulation of the ink surface is suppressed during a reciprocating scanning operation of carriage 2.

Tenth Embodiment

Figure 28:
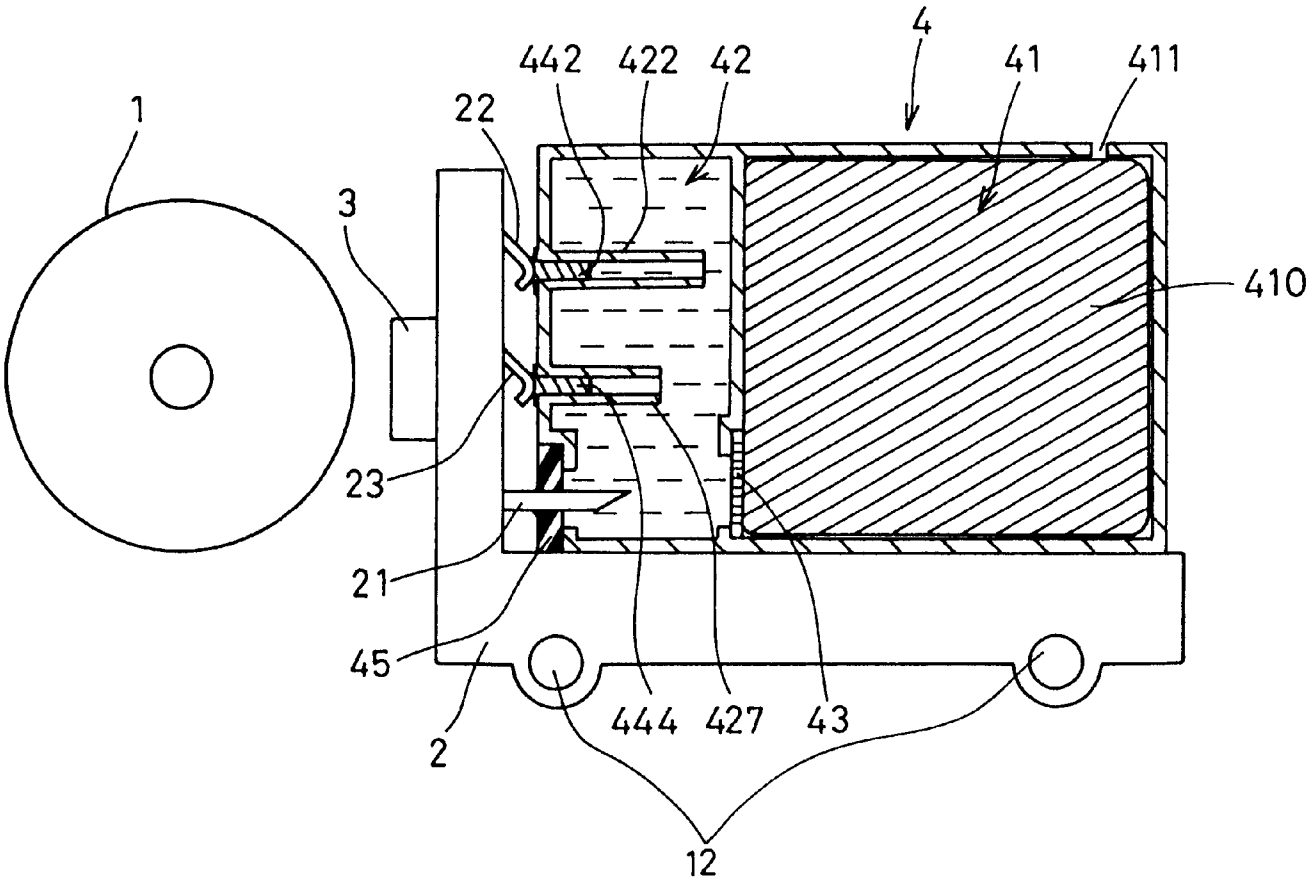
FIG. 28 is a partial sectional side view in the proximity of the carriage having an ink cartridge attached to an ink jet printer according to a tenth embodiment.

A tenth embodiment of the present invention allows detection of the remaining amount of ink by a plurality of stages on the basis of a principle similar to that of the fifth embodiment. FIG. 28 is a partial sectional side view in the proximity of a carriage having an ink cartridge loaded in an ink jet printer of the ninth embodiment. In FIG. 28, components corresponding to those of FIG. 18 have the same reference characters denoted, and their description will not be repeated.

The ink jet printer of FIG. 28 is similar to that of FIG. 18, with a second electrode 444 and a second sleeve 427 provided in ink cartridge 4, and a second terminal 23 provided in carriage 2. The difference in ink jet printer of FIG. 28 from that of FIG. 18 will be described hereinafter.

In ink chamber 42 of ink cartridge 4, a second sleeve 427 having a structure similar to that of first sleeve 422 is provided between first sleeve 422 and inserted hollow needle electrode 21. Second sleeve 427 is lower in height than first sleeve 422.

In second sleeve 427, a second electrode 444 having a structure similar to that of first electrode 442 is inserted. Second terminal 23 has a structure similar to that of first terminal 22. It is provided in carriage 2 so as to come into contact with second electrode 444 when ink cartridge 4 is loaded in carriage 2.

Figure 29:
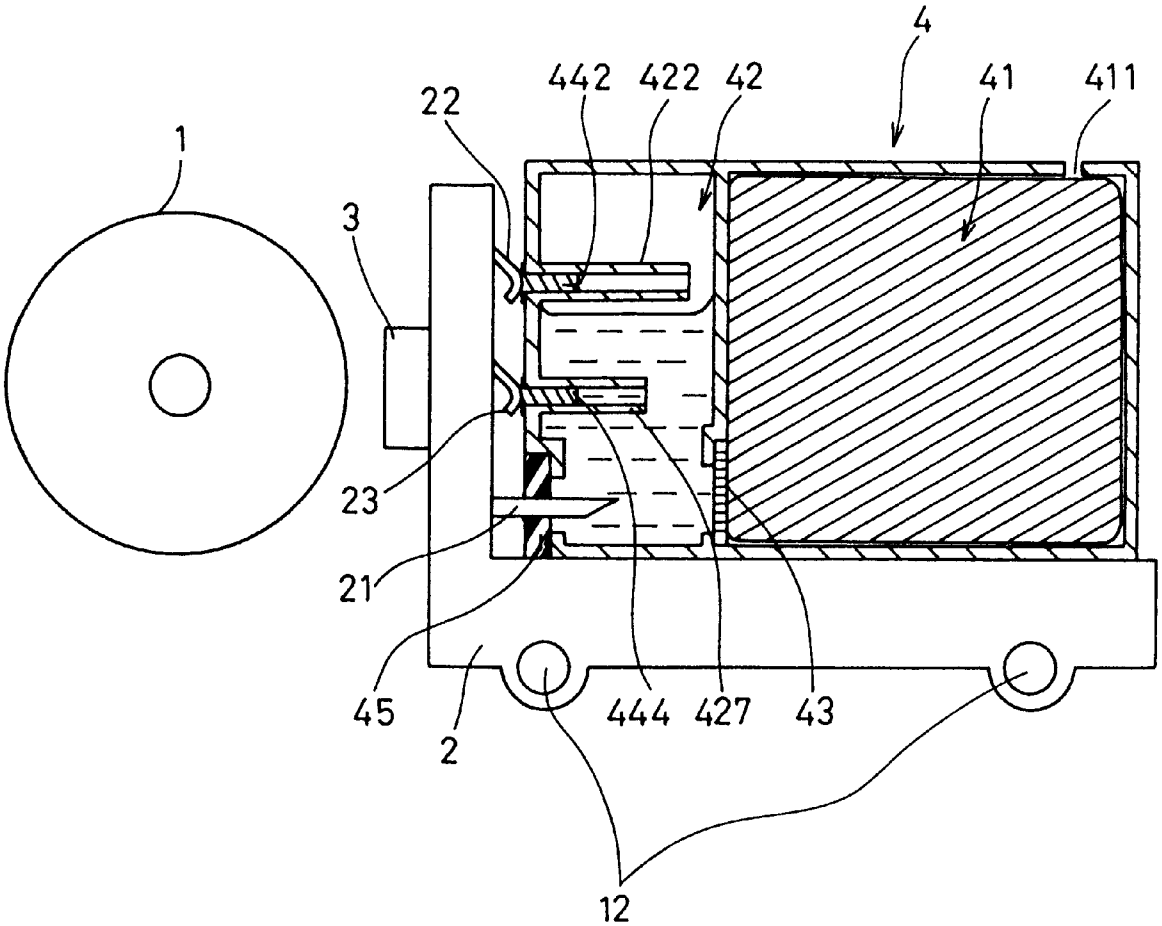
FIG. 29 is a partial sectional side view in the proximity of a carriage showing reduction in the amount of ink in the ink cartridge of the ink jet printer according to the tenth embodiment of the present invention.
Figure 30:
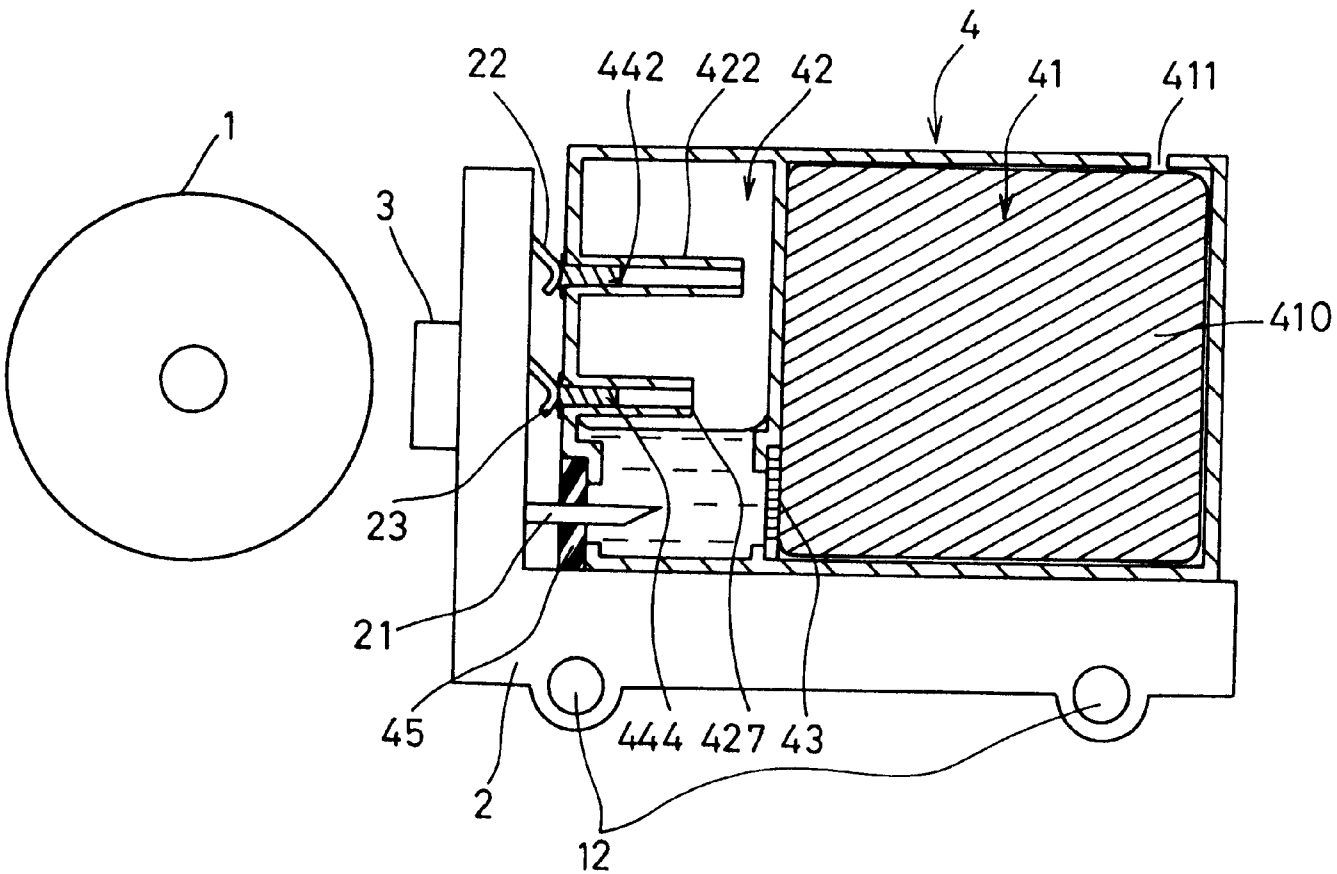
FIG. 30 is a partial sectional side view in the proximity of a carriage indicating further reduction in the amount of ink in the ink cartridge of the ink jet printer according to the tenth embodiment.

Reduction of ink in ink cartridge 4 shown in FIG. 28 will be described. FIGS. 29 and 30 are partial sectional side views in the proximity of carriage 2 in an ink cartridge 4 of the ink jet printer of the tenth embodiment.

When the remaining amount of ink in ink cartridge 4 becomes low, first electrode 442 and first sleeve 422 are exposed as shown in FIG. 29. Since the possibility of air intruding into hollow needle electrode 21 is low, it is not necessary to stop the printing operation. When the remaining amount of ink is further reduced, second electrode 444 and second sleeve 427 are exposed as shown in FIG. 30. The possibility of air intruding into hollow needle electrode 21 is great if a printing operation is continued. Therefore, it is necessary to cease the printing operation.

The ink remaining amount detection system of the ink jet printer according to the tenth embodiment will be described hereinafter.

Figure 31:
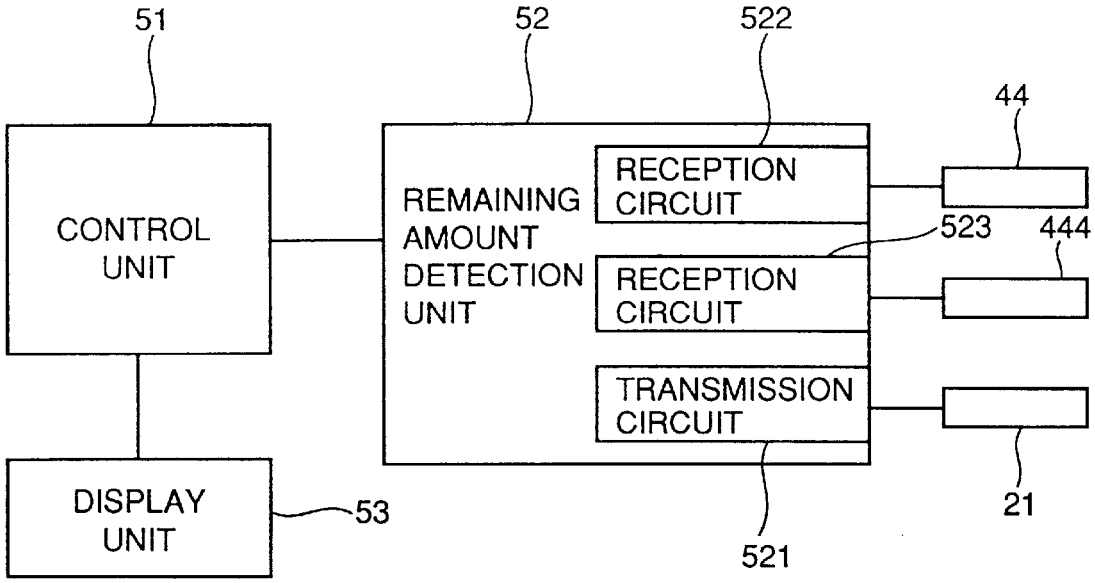
FIG. 31 is a block diagram showing the structure of an ink remaining amount detection system according to the tenth embodiment.

FIG. 31 is a block diagram showing an entire structure of an ink remaining amount detection system of an ink jet printer according to the tenth embodiment. The ink remaining amount detection system of FIG. 31 has a structure of the ink remaining amount system of FIG. 11 with a second electrode 444 and a second reception circuit 523 connected thereto additionally in remaining amount detection unit 52.

The structure of remaining amount detection unit 52 of the ink jet printer of the tenth embodiment will be described hereinafter. FIGS. 32(*a*)–32(*c*) are circuit diagrams showing the structures of an transmission circuit 521 and reception circuits 522 and 523 of remaining amount detection unit 52. In the circuit of FIGS. 32(*a*)–32(*c*), components corresponding to those of the circuit in FIG. 12 has the same reference characters denoted, and their description will not be repeated.

The structure of the circuit of FIGS. 32(*a*)–32(*c*) are similar to that of the circuit of FIGS. 12(*a*) and 12(*b*) with a second reception circuit 523 additionally provided. The structure of second reception circuit 523 is similar to that of first reception circuit 522, and their description will not be repeated. Node N8 in second reception circuit 523 corresponds to node N4 in first reception circuit 522. Node N9 in second reception circuit 523 corresponds to node N7 of first reception circuit 522. The operation of second reception circuit 523 is similar to that of first reception circuit 522, and their description will not be repeated.

Figure 33:
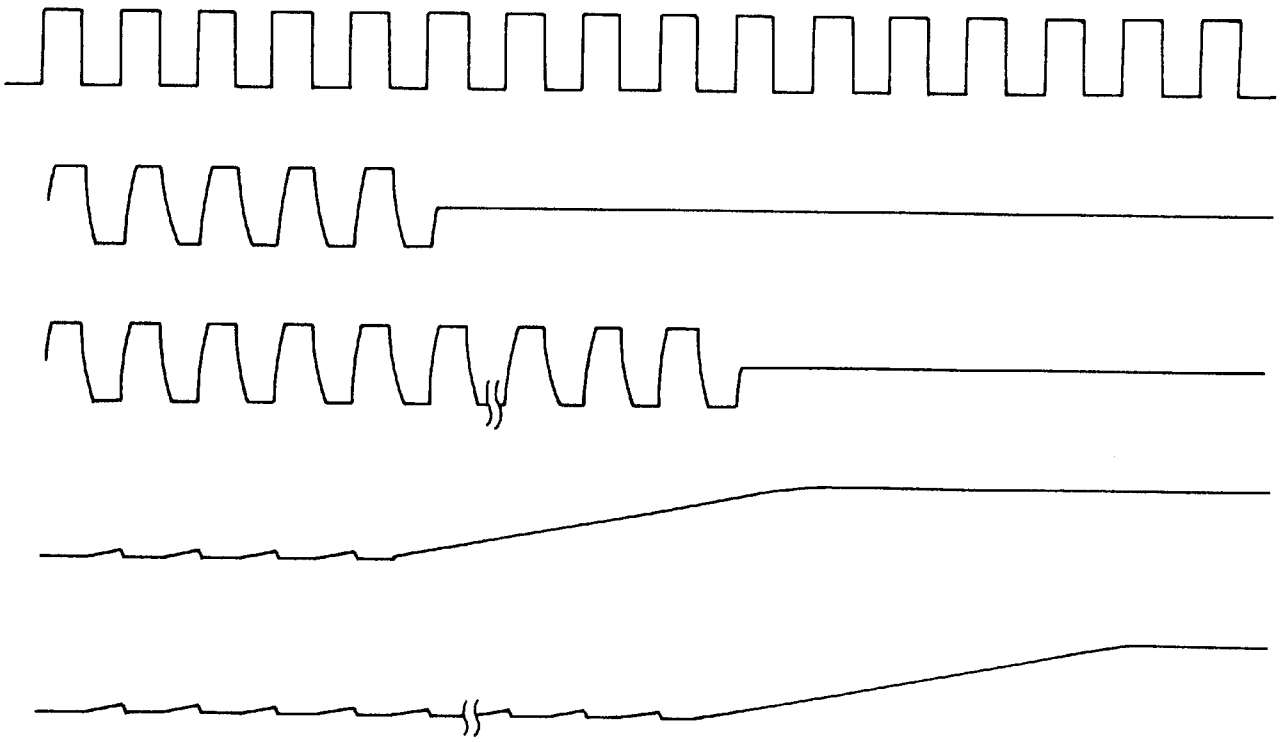
FIG. 33 is a waveform diagram showing signal waveforms of the transmission and reception circuits of the ink remaining amount detection unit according to the tenth embodiment.

FIG. 33 is a waveform diagram showing signal waveforms in transmission circuit 521 and reception circuits 522 and 523 of remaining amount detection unit 52. Referring to FIG. 33, (a)–(e) show signal waveforms at input node N1, node N4, node N8, output node N7, and output node N9, respectively.

The relationship of the signal waveforms shown in (a), (b) and (d) is similar to that described with reference to FIG. 13 indicating the first embodiment. The signal waveform of node N8 (c) and the signal waveform of output node N9 (e) of second reception circuit 523 show a waveform change similar to the signal waveforms of node N4 (b) and output node N9 (d) of first reception circuit 522 after a start of change thereof.

When the remaining amount of ink in ink chamber 42 becomes low, detection is made that the supply of ink has become lower than a first set amount by first reception circuit 522. When the remaining amount of ink is further reduced, detection is made that the remaining amount of ink has become lower than a second set value by second reception circuit 523.

More specifically, determination is made of the remaining amount of ink in ink cartridge 4 according to the output level of first reception circuit 522 and the output level of second reception circuit 523 in control unit 51.

When the output levels of first and second reception circuits 522 and 523 are both low, determination is made that there is sufficient amount of ink. When the output level of first reception circuit 522 is low and the output level of second reception circuit 523 is high, determination is made that the remaining amount of ink is below a first set value (referred to as "ink near empty" state hereinafter).

When the output levels of first and second reception circuits 522 and 523 are both high, determination is made that the remaining amount of ink is below a second set value (referred as "ink empty" state hereinafter).

Figure 34:
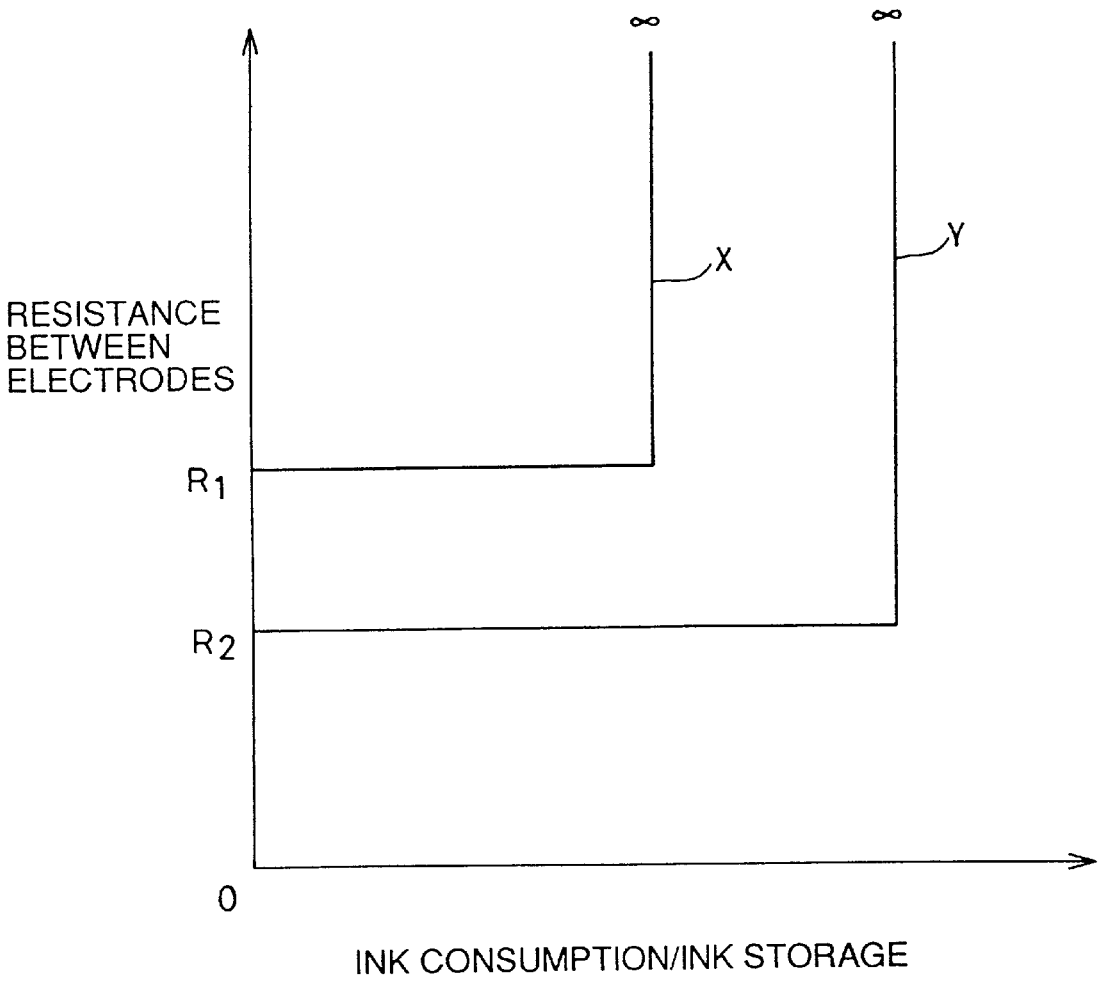
FIG. 34 is a graph showing the relationship between the remaining amount of ink and resistance between electrodes according to the tenth embodiment.

FIG. 34 is a graph showing characteristic X representing the relationship between the remaining amount of ink in ink cartridge 4 and the resistance value between first electrode 442 and hollow needle electrode 21, and characteristic Y representing the relationship of the remaining amount of ink and the resistance value between second electrode 444 and hollow needle electrode 21.

In FIG. 34, the resistance value between the electrodes is plotted along the ordinate, and data representing the remaining amount of ink, i.e. the ratio of the amount of consumed ink to the amount of stored ink (ink consumed amount/ink storage amount) is plotted along the abscissa.

Characteristic X indicates that the resistance value between a first electrode 442 and hollow needle electrode 21 takes an infinite value in a step-graded manner from a constant resistance value of R1 when first electrode 442 of FIG. 29 is exposed from the ink surface according to the principle described with reference to FIG. 14. Similarly, characteristic Y shows that the resistance value between second electrode 444 and hollow needle electrode 21 takes an infinite value in a step-graded manner from a constant resistance value R2 when second electrode 444 is exposed from the ink surface as shown in FIG. 30.

Because the resistance values between respective electrodes is characterized by suddenly increasing at a predetermined amount of remaining ink, the remaining amount of ink can be detected at a plurality of stages in control unit 51 according to such characteristics.

Figure 35:
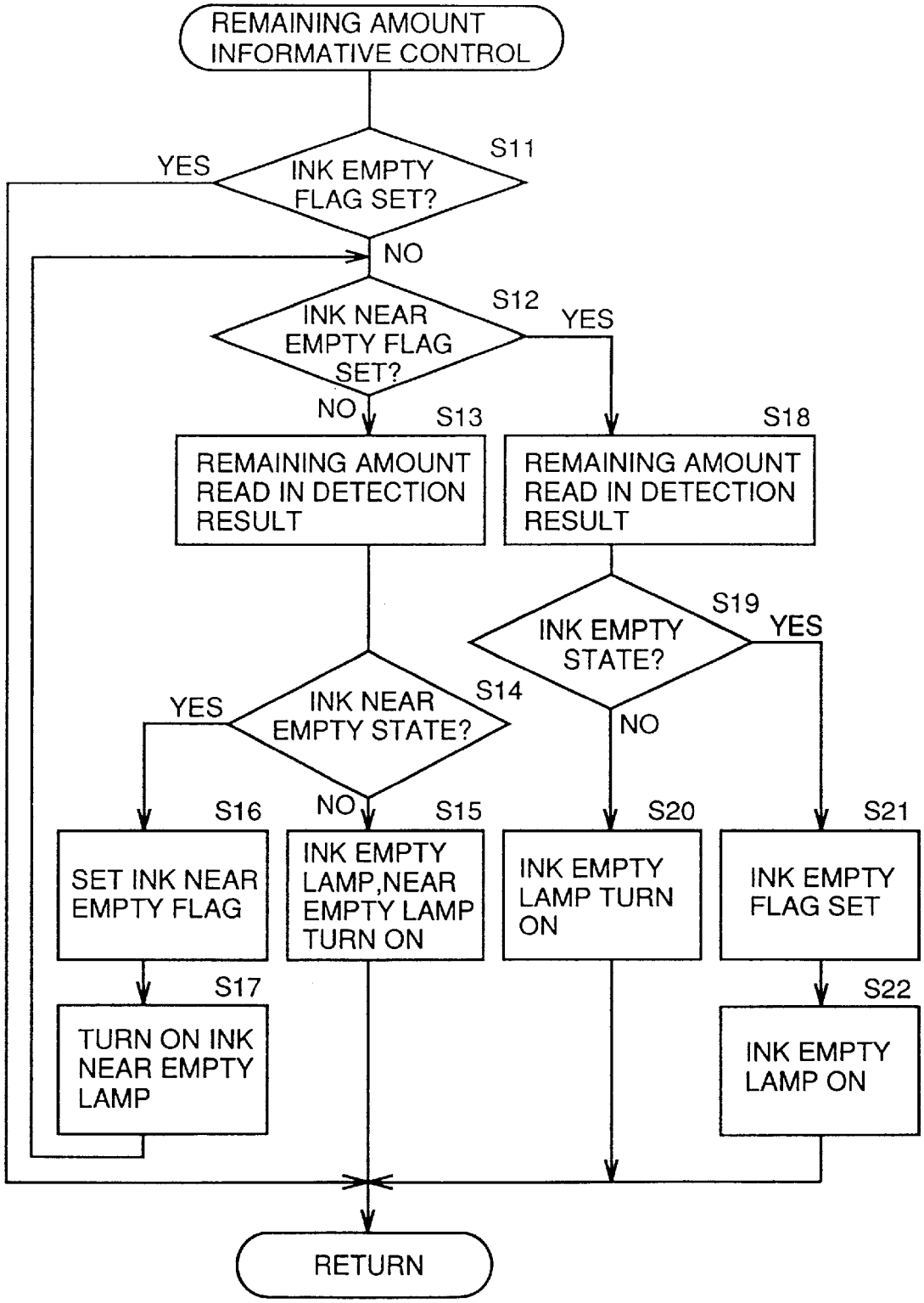
FIG. 35 is a flow chart of a remaining amount information control according to the tenth embodiment.
Figure 36:
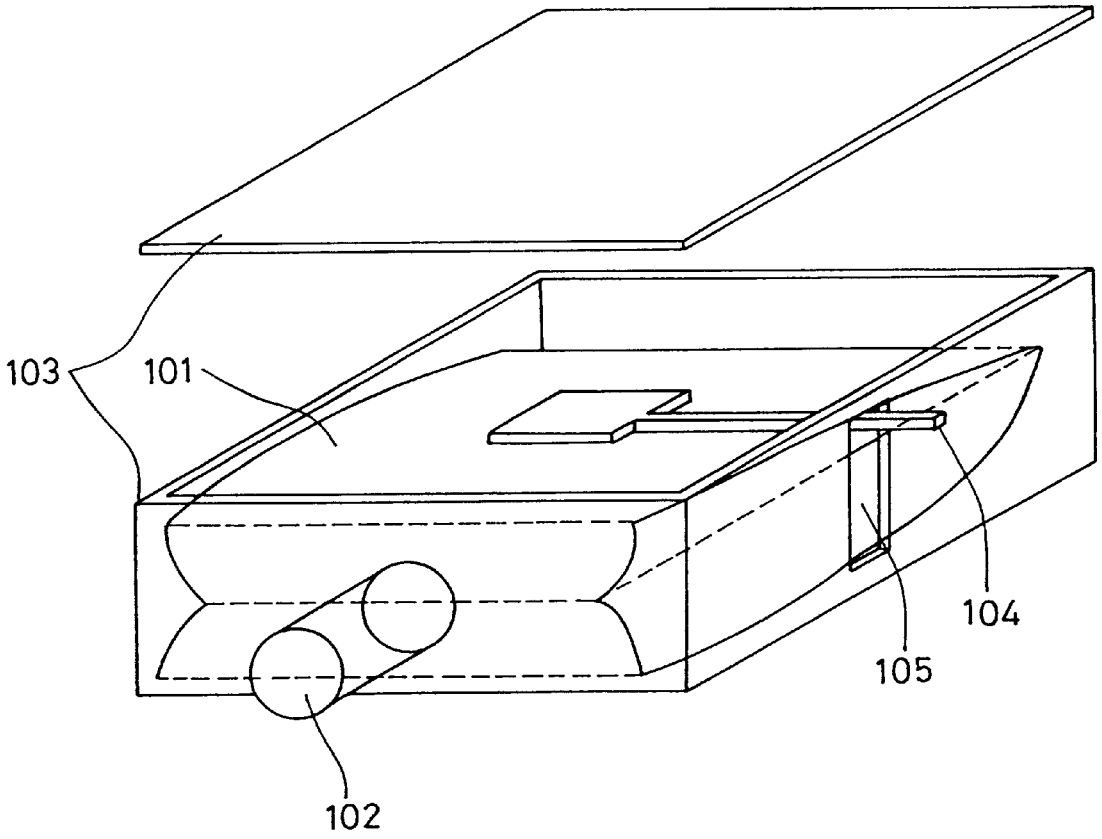
FIG.36 PRIOR ART
FIG. 36 is a perspective view showing a structure of an ink cartridge of a first conventional ink jet printer.

Remaining amount information control carried out in control unit 51 will be described hereinafter. FIG. 35 is a flow chart of the remaining amount information control according to the tenth embodiment. This remaining amount information control is carried out according to a subroutine program actuated by a main routine for the main control of the operation of the ink jet printer.

At step S11, determination is made whether an ink empty flag is set or not. An empty flag indicates that the remaining amount of ink in ink cartridge 4 has come to an ink empty state. When determination is made that an ink empty flag is set, the control returns to the main routine. When determination is made that an ink empty flag is not set, the control proceeds to step S12.

At step S12, determination is made whether an ink near empty flag is set or not. An ink near empty flag indicates that ink cartridge 4 is near empty. When determination is made that an ink near empty flag is set, the control proceeds to step S18, otherwise to step S13.

The ink empty flag is set at step S21, and the ink near empty flag is set at step S16. The ink empty flag and the ink near empty flag are reset when the power of the ink jet printer is turned on, and reset by operating a clear switch which is a mechanical switch provided at an appropriate position.

When control proceeds to step S13, the detection result of the remaining amount of ink is read from remaining amount detection unit 52. At step S14, determination is made whether the detection result read in step S13 represents an ink near empty state. When determination is made that the detection result does not represent an ink near empty state, the control proceeds to step S15, otherwise to step S16.

When control proceeds to step S15, the ink empty lamp and the ink near empty lamp are turned off, and control returns to the main routine.

When control proceeds to step S16, the ink near empty flag is set. At step S17, the ink near empty lamp is turned on, and the process returns to step S12.

When control proceeds to step S18, the detection result of remaining amount detection unit 52 is read in. At step S19, determination is made whether the detection result read in step S18 represents an ink empty state or not. When determination is made that the detection result does not represent an ink empty state, control proceeds to step S20, otherwise to step S21.

When control proceeds to step S20, the ink empty lamp is turned off, and control returns to the main routine.

When control proceeds to step S21, the ink empty flag is set. At step S22, the ink empty lamp is turned on, and control returns to the main routine.

According to the above-described remaining amount information control, the remaining amount of ink is informed at two stages of an ink near empty state and an ink empty state. Also, whether ink cartridge 4 is loaded or not is informed. The user can be informed of the need to exchange ink cartridge 4 and whether ink cartridge 4 is loaded or not.

It is advantageous that the user can be notified of a low supply of ink at an early stage according to the information of an ink near empty state by the remaining amount information control. Because the user can use the ink in ink cartridge 4 until the very limit of printing on account of being informed of an ink empty state, ink in ink cartridge 4 can be used without waste.

Although detection of the remaining amount of ink will be carried out in two stages in the tenth embodiment, detection may be made by plurality of stages more in number than the two stages. In this case, a corresponding number of electrodes and reception circuits are provided in ink chamber 42. Detection of the remaining amount of ink at a plurality of stages will facilitate grasp of the state of the remaining amount of ink.

Although the tenth embodiment was described in which carriage 2 and ink cartridge 4 are used in a horizontal disposed state, detection of the remaining amount of ink can be made even when carriage 2 and ink cartridge 4 are disposed in a vertical manner in the ink jet printer of FIG. 10. When the ink jet printer is used in such a vertical disposed state, detection of the remaining amount of ink is allowed according to the principle similar to that of the ink jet printer of FIG. 17 according to the fourth embodiment. In usage of the basis of a vertical disposed state, first electrode 442 is first exposed from the surface of ink, followed by exposure of second electrode 444. Therefore, the remaining amount of ink can be detected at a plurality of stages.

The remaining amount of ink of an ink empty state is preferably selected so that at least one paper sheet can be printed.

The effects obtained by the present invention are set forth in the following.

The usage of an ink exhaustion detecting liquid not miscible with ink and having different electrical resistance ensures detection of ink exhaustion by electrodes being surrounded with ink exhaustion detecting liquid when the remaining amount of ink becomes low. The spacing between electrodes can be reduced to allow reduction in size and weight. When there is a sponge or the like in the container, the sponge impregnated with ink is completely substituted by the ink exhaustion detecting liquid, to ensure detection of decrease in ink regardless of the sponge located between the electrodes.

According to the present invention, the remaining amount of ink is detected on the basis of a conductive state between a plurality of electrodes provided in an ink chamber. Therefore, the structure of the apparatus can be simplified. Detection of the remaining amount of ink on the basis of a conductive state between electrodes is reliable and accurate according to the fact that the conductive state between electrodes is based on a definite conductive or non-conductive state. Thus, the accuracy of the detection of the remaining amount of ink can be improved without increasing the complexity of the structure of the device.

According to another aspect of the present invention, detection of the remaining amount of ink is carried out according to change in the conductive state between the electrodes when the remaining amount of ink is low in accordance with the ink in the ink chamber being separated by dividing means. Therefore, in addition to the above-described effects, detection of the remaining amount of ink can be made with the dividing means position between electrodes spaced apart in a horizontal direction and also in a vertical direction.

According to a further aspect of the present invention, the cross section of the ink chamber has a convex configuration. Undulation of ink in the ink chamber can be suppressed even when the ink chamber is moved horizontally under a low supply of ink due to the configuration of the ink chamber. Therefore, steady detection of the remaining amount of ink can be carried out.

According to another aspect of the present invention, the remaining amount of ink can be detected on the basis of change of a conductive state between the electrodes caused by the surface of the ink lowered to the position between the tip of the first electrode and the second electrode. Therefore, detection of the remaining amount of ink can be made with first and second electrodes spaced apart horizontally and vertically.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink cartridge for an ink jet printer comprising:

a container for storing liquid, ink for printing having an electrical resistance of a first value, stored in a first portion of said container, an ink exhaustion indicating liquid having an electrical resistance of a second value which is greater than said first value stored in a second portion of said container, a first porous member located inside said container and impregnated with said ink exhaustion indicating liquid, a second porous member accommodated inside said container, and impregnated with said ink, and isolation means provided between first and second porous members for completely isolating said members from each other.

2. The ink cartridge for an ink jet printer according to claim 1, wherein said isolation means is formed of a flexible film member for completely isolating said first porous member from said second porous member.

3. The ink cartridge for an ink jet printer according to claim 2, comprising:

a draw out hole provided at a wall of said container for removing said flexible film member outwardly of said container, a rubber member, including a portion for receiving a plug member, provided in said draw out hole for substantially sealing said draw out hole and allowing said flexible film member to be drawn outwardly of said container, and a resilient plug member provided at an edge of said flexible film member inside said container, wherein said plug member contacts and is fitted into said rubber member at said draw out hole when said flexible film member is drawn outwardly of said container.

4. The ink cartridge for an ink jet printer according to claim 1, including means for removing said isolation means, so that said first and second porous members contact each other.

* * * * *

UNITED STATES PATENT AND TRADEMARK OFFICE

CERTIFICATE OF CORRECTION

PATENT NO. : 6,286,921 B1
DATED : September 11, 2001
INVENTOR(S) : N. Ochi et al.

Figure 12A:
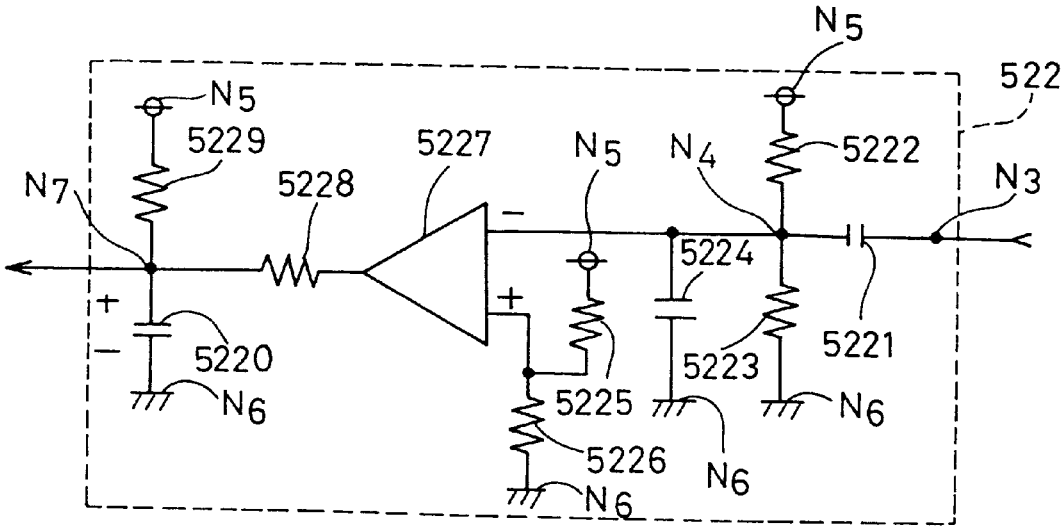
FIGS. 12(*a*) and 12(*b*) are circuit diagrams showing structures of a transmission circuit and a reception circuit of the ink remaining amount detection unit.
Figure 12B:
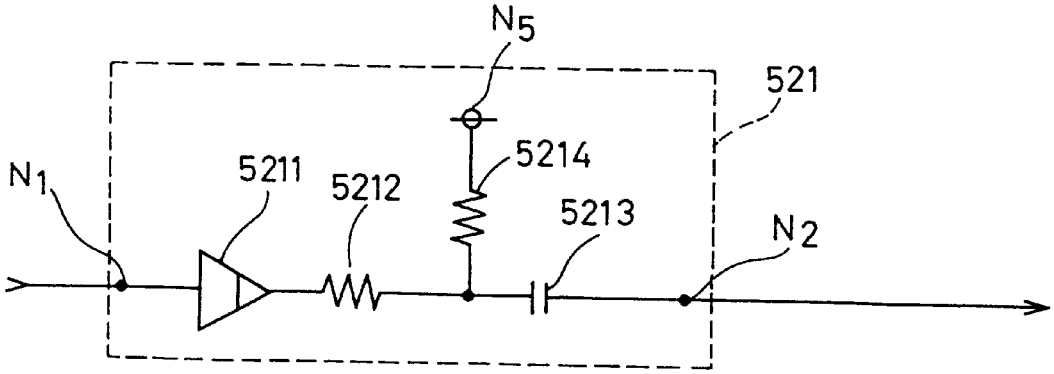
Figure 13:
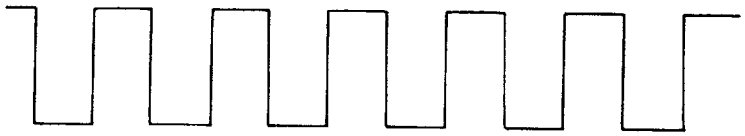
FIG. 13 is a waveform diagram showing signal waveforms of the transmission and reception circuits of the ink remaining amount detection unit.
Figure 13:
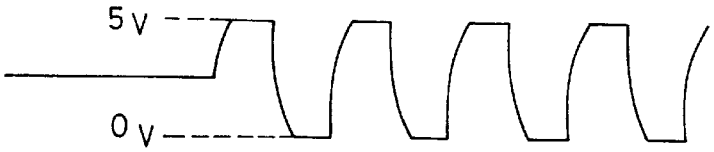
Figure 13:
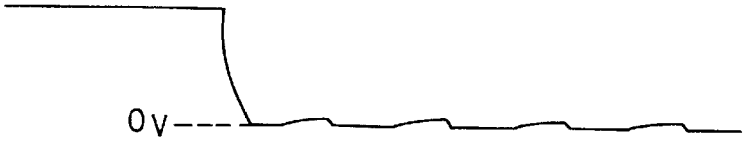

It is certified that error appears in the above-identified patent and that said Letters Patent is hereby corrected as shown below:

Column 18,
Line 61, delete "Figure 12 has" and insert -- Figs. 12(a) and 12(b) have -- in its place.

Signed and Sealed this

Thirtieth Day of April, 2002

*Attest:*

*Attesting Officer*

JAMES E. ROGAN
*Director of the United States Patent and Trademark Office*